US009367029B1

(12) United States Patent
Blair et al.

(10) Patent No.: US 9,367,029 B1
(45) Date of Patent: Jun. 14, 2016

(54) RESETTABLE SEPARATOR FOR ELECTROPHOTOGRAPHIC COMPONENTS

(71) Applicant: LEXMARK INTERNATIONAL, INC., Lexington, KY (US)

(72) Inventors: Brian Allen Blair, Richmond, KY (US); Derek Masami Inouye, Lexington, KY (US); Brian Reed Spencer, Lexington, KY (US); Gary Michael Tylicki, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/938,999

(22) Filed: Nov. 12, 2015

(51) Int. Cl.
*G03G 21/16* (2006.01)

(52) U.S. Cl.
CPC ..... *G03G 21/1676* (2013.01)

(58) Field of Classification Search
None
See application file for complete search history.

(56) References Cited

U.S. PATENT DOCUMENTS

2012/0183321 A1* 7/2012 Mori ..... G03G 1/1633 399/110

* cited by examiner

*Primary Examiner* — Clayton E LaBalle
*Assistant Examiner* — Jas Sanghera
(74) *Attorney, Agent, or Firm* — John Victor Pezdek

(57) ABSTRACT

A reusable and resettable separator for use with electrophotographic components of an imaging device. The separator is installed with the imaging device and includes a spring-biased lift rail and release linkage and is used to move either a developer unit or a photoconductive drum unit between an operative position where a developer roll and a photoconductive drum form a contact nip and a separated position where the two rolls are separated. The separator is initially set using the lift rail to place two rolls in the separated position with the release linkage engaging the lift rail to hold this position. Opening of an access door engages a one-way release arm actuating the release linkage allowing the lift rail to translate moving the two rolls to the operative position. When reshipment of the imaging device is needed, the separator can manually reset placing the two rolls back in the separated position.

19 Claims, 16 Drawing Sheets

RESETTABLE SEPARATOR FOR ELECTROPHOTOGRAPHIC COMPONENTS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to imaging devices, and more particularly to devices used to separate developer units from photoconductive drums in an imaging device.

2. Description of the Related Art

For an electro-photographic printer that utilizes a contact nip between photoconductor (PC) drum and developer rolls in an electrophotographic imaging device to produce a toned image onto media, it is a common practice to physically separate contact interfaces during packaging and shipping of the printer. This separation helps to prevent out-of-box delivery failures to the imaging system components, such as developer roll compression set and cold toner fusion roll defects. For a monochrome imaging device there is typically one PC drum-developer roll contact nip. For a color imaging device, there are four such contact nips—one each for yellow, cyan, magenta, and black.

To ameliorate these concerns, in the prior art, a separator mechanism for spacing the PC drum from the developer roll was inserted prior to packaging and shipping of the imaging device. While automatic control of this separating mechanism is possible, it is generally considered too cost-prohibitive, and/or requires too much additional space within the imaging device housing. Therefore, prior art embodiments have used disposable packaging materials to hold the PC drum developer roll interface in its separated state during shipping. These materials are then removed during initial un-boxing and set-up of the imaging device by the end user to allow contact between the PC drum and developer roll. However, such embodiments do have the drawback of requiring the end user to perform this set-up operation, as opposed to the benefit of having the action being automatic and transparent to the end user. There is also the added concern regarding the status of these imaging components should the printer need to be re-packaged and reshipped after the initial set-up. For example, imaging devices may be centrally configured in bulk by a given customer, such as a pharmacy chain or bank, and then later be re-distributed to various locations.

Ideally, when reshipping is needed, the contact nip is re-separated to help prevent roll defects. However, there is a question of how the separation is to be achieved should the packaging materials have been disposed of or are unavailable. It would be an improvement over the prior art if the separating mechanism remained with the imaging device and could be reset should reshipping be needed. It would be advantageous if resetting could be done without having to rely on reinserting removable and possibly disposable packaging materials or require the use of special tools. It would be further advantageous to be able to place the PC drum and developer roll into contact when the system is to be ready for printing without additional user actions.

SUMMARY

Disclosed is a reusable and resettable separator for use with electrophotographic components of an imaging device. The separator is installed in the imaging device and includes a spring-biased lift rail and a release linkage and is used to move either a developer unit or a photoconductive drum unit between an operative position where a developer roll and a photoconductive drum form a contact nip and a separated position where the two rolls are separated. Prior to initial shipment to a customer, the separator is initially set by translating the lift rail so that the two rolls are in the separated position and the release linkage engages with the lift rail to maintain its position. Opening of an access door during initial installation of toner cartridges for the imaging device, the access door engages a one-way release arm translating the release linkage releasing the lift rail allowing the two rolls to move into the operative position. Where reshipment of the imaging device is needed, the separator may be reused by being manually reset by translating the lift rail away from the release linkage allowing the release linkage to reengage with the lift rail so that the two rolls are placed in the separated position.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

FIG. 6 shows an interior view and FIG. 7 shows the exterior view of the rear panel.

FIG. 14 shows complete separation of the respective units, FIG. 15 shows the operative positions of the respective units, FIG. 16 shows a first angled separation where the contact occurs adjacent to the right ends of the respective units, and, FIG. 17 shows a second angled separation where contact occurs adjacent to the left ends of the respective units.

FIGS. 22-24 illustrate the operation of a one-way release lever for the example separator of the present disclosure wherein FIG. 22 illustrates the developer and PC units in a separated position, the separator in an engaged position and the closing of an access door where an actuation post folds the release lever leaving the developer and PC units in their separated position; FIG. 23 shows the access door in the closed position, and, FIG. 24 shows the release lever being engaged by an actuation post on the access door during opening of the access door which rotates the release lever to place the separator in a released position moving the developer and PC units into the operative position.

DETAILED DESCRIPTION

Figure 1:
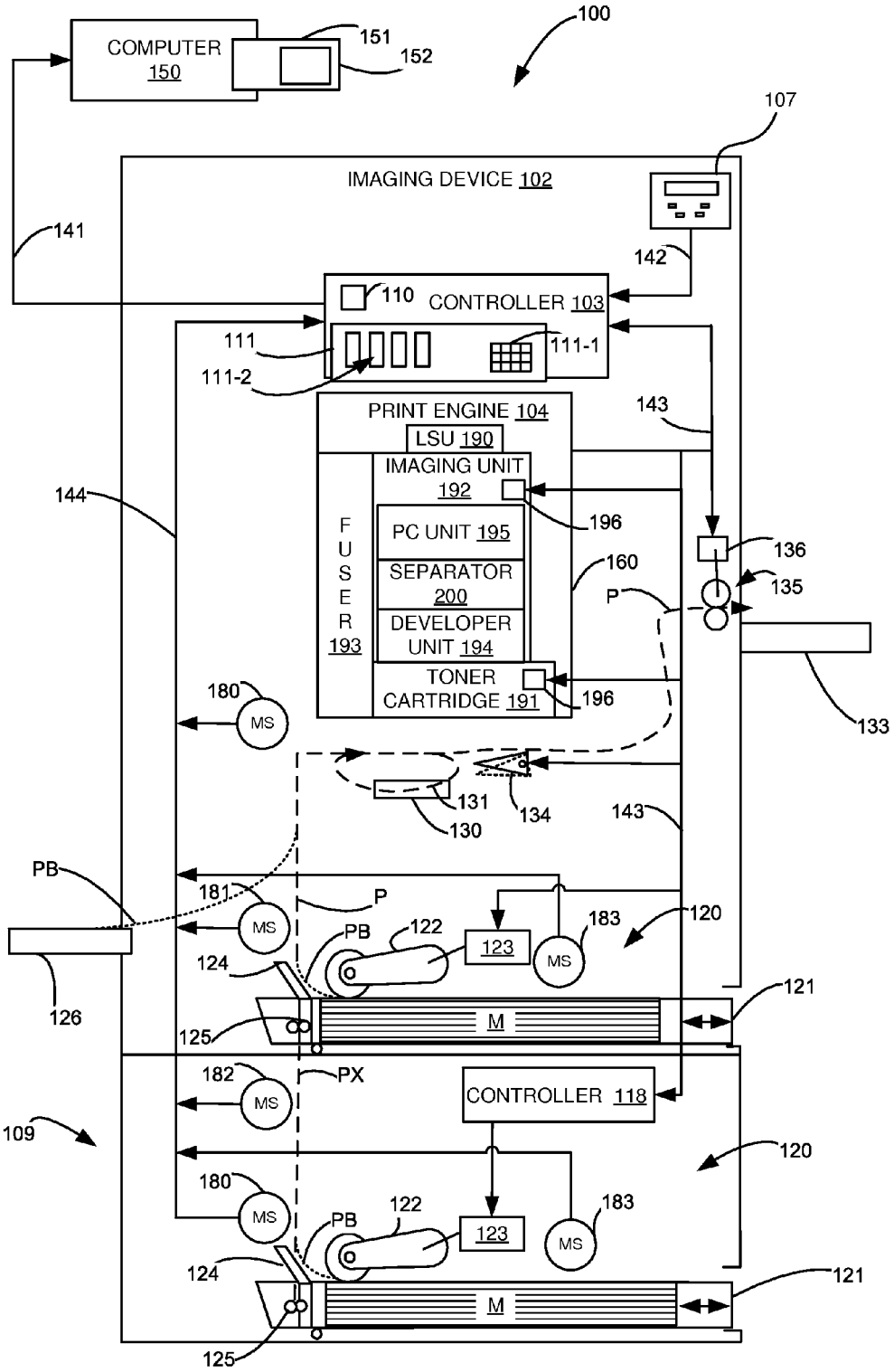
FIG. 1 is a schematic illustration of an imaging device and finisher with a media accumulator-ejector of the present disclosure.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise. The use of "including", "comprising", or "having" and variations thereof herein is meant to encompass the items listed thereafter and equivalents thereof as well as additional items. Terms such as "about" and the like are used to describe various characteristics of an object, and such terms have their ordinary and customary meaning to persons of ordinary skill in the pertinent art.

Terms such as "about" and the like have a contextual meaning and are used to describe various characteristics of an object, and such terms have their ordinary and customary meaning to persons of ordinary skill in the pertinent art. Terms such as "about" and the like, in a first context mean "approximately" to an extent as understood by persons of ordinary skill in the pertinent art; and, in a second context, are used to describe various characteristics of an object, and in such second context mean "within a small percentage of" as understood by persons of ordinary skill in the pertinent art.

Unless limited otherwise, the terms "connected", "coupled", and "mounted", and variations thereof herein are used broadly and encompass direct and indirect connections, couplings, and mountings. In addition, the terms "connected" and "coupled" and variations thereof are not restricted to physical or mechanical connections or couplings. Spatially relative terms such as "left", "right", "top", "bottom", "front", "back", "rear", "side", "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

In addition, it should be understood that embodiments of the present disclosure include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the present disclosure and that other alternative mechanical configurations are possible.

The term "image" as used herein encompasses any printed or electronic form of text, graphics, or a combination thereof. "Media" or "media sheet" refers to a material that receives a printed image or, with a document to be scanned, a material containing a printed image. The media is said to move along a media path, a media branch, and a media path extension from an upstream location to a downstream location as it moves from the media trays to the output area of the imaging system. For a top feed option tray, the top of the option tray is downstream from the bottom of the option tray. Conversely, for a bottom feed option tray, the top of the option tray is upstream from the bottom of the option tray. As used herein, the leading edge of the media is that edge which first enters the media path and the trailing edge of the media is that edge that last enters the media path. Depending on the orientation of the media in a media tray, the leading/trailing edges may be the short edge of the media or the long edge of the media, in that most media is rectangular. As used herein, the term "media width" refers to the dimension of the media that is transverse to the direction of the media path. The term "media length" refers to the dimension of the media that is aligned to the direction of the media path. "Media process direction" describes the movement of media within the imaging system, and is generally means from an input toward an output of the imaging system. Further, relative positional terms may be used herein. For example, "superior" means that an element is above another element. Conversely "inferior" means that an element is below or beneath another element Media is conveyed using pairs of aligned rolls forming feed nips. The term "nip" is used in the conventional sense to refer to the opening formed between two rolls that are located at about the same point in the media path. The rolls forming the nip may be separated apart, be tangent to each other, or form an interference fit with one another. With these nip types, the axes of the rolls are parallel to one another and are typically, but do not have to be, transverse to the media path. For example, a deskewing nip may be at an acute angle with respect to the media feed path. The term "separated nip" refers to a nip formed between two rolls that are located at different points along the media path and have no common point of tangency with the media path. Again, the axes of rotation of the rolls having a separated nip are parallel but are offset from one another along the media path. Nip gap refers to the space between two rolls. Nip gaps may be positive, where there is an opening between the two rolls, zero, where the two rolls are tangentially touching, or negative, where there is an interference fit between the two rolls.

As used herein, the term "communication link" is used to generally refer to a structure that facilitates electronic communication among components. While several communication links are shown, it is understood that a single communication link may serve the same functions as the multiple communication links that are illustrated. Accordingly, a communication link may be a direct electrical wired connection, a direct wireless connection (e.g., infrared or r.f.), or a network connection (wired or wireless), such as for example, an Ethernet local area network (LAN) or a wireless networking standard, such as IEEE 802.11. Devices interconnected by a communication link may use a standard communication protocol, such as for example, universal serial bus (USB), Ethernet or IEEE 802.xx, or other communication protocols. The terms "input" and "output" when applied to a sensor, circuit or other electronic device means an electrical signal that is produced by or is acted upon by such sensor, circuit or electronic device. Such electrical signals may be analog or digital signals.

Referring now to the drawings and particularly to FIG. 1, there is shown a diagrammatic depiction of an example imaging system 100. As shown, imaging system 100 may include an imaging device 102 and an optional computer 150 attached to the imaging device 102. Imaging device 102 is shown as an electrophotographic printer that includes a controller 103, a print engine 104, a user interface 107, an option assembly 109 and a separator 200.

Controller 103 includes a processor unit 110 and associated memory 111, and may be formed as one or more Application Specific Integrated Circuits (ASICs). Memory 111 may be any volatile or non-volatile memory or combination thereof such as, for example, random access memory (RAM), read only memory (ROM), flash memory and/or non-volatile RAM (NVRAM). Alternatively, memory 111 may be in the form of a separate electronic memory (e.g., RAM, ROM, and/or NVRAM), a hard drive, a CD or DVD drive, or any memory device convenient for use with controller 103. Provided in memory 111 is one or more look-up tables 111-1 and/or firmware modules 111-2 used for control of imaging device 102 and its attachments such as option assembly 109.

In FIG. 1, controller 103 is illustrated as being communicatively coupled with computer 150 via communication link 141 and with user interface 107 via communication link 142. Computer 150 includes in its memory 151 a software program including program instructions that function as an imaging driver 152, e.g., printer/scanner driver software, for imaging device 102. Imaging driver 152 facilitates communication between imaging device 102 and computer 150. One aspect of imaging driver 152 may be, for example, to provide formatted print data to imaging device 102, and, more particularly, to print engine 104, to print an image. In some circumstances, it may be desirable to operate imaging device 102 in a standalone mode. In the standalone mode, imaging device 102 is capable of functioning without computer 150. Accordingly, all or a portion of imaging driver 152, or a similar driver, may be located in a firmware modules 111-2 within controller 103 of imaging device 102 so as to accommodate printing functionality when operating in the standalone mode. Controller 103 may provide computer 150 and/or to user interface 107 with status indications and messages regarding the media, including media to be printed, imaging device 102 itself or any of its subsystems, consumables status, etc. Computer 150 may provide operating commands to imaging device 102. Computer 150 may be located nearby imaging device 102 or be remotely connected to imaging device 102 via an internal or external computer network. Imaging device 102 may also be communicatively coupled to other imaging devices.

Controller 103 is illustrated as being communicatively coupled with print engine 104 via communication link 143. Print engine 104 and user interface 107 may be controlled by firmware modules 111-2, maintained in memory 111, and performed by controller 103 or another processing element. Controller 103 serves to process print data, operate print engine 104 and toner cartridge 191 during printing, and move media through imaging device 102.

Print engine 104 is illustrated as including a laser scan unit (LSU) 190, a toner cartridge 191, an imaging unit 192, and a fuser 193, all mounted within a frame 160 of imaging device 102. Imaging unit 192 and toner cartridge 191 are supported in their operating positions with the frame 160 of imaging device 102 so that toner cartridge 191 is operatively mated to imaging unit 192 while minimizing any unbalanced loading forces applied by the toner cartridge 191 on imaging unit 192.

Imaging unit 192 is removably mounted within imaging device 102 and includes a developer unit 194 that houses a developer roll, a toner sump and a toner delivery system and a photoconductor unit (PC unit) 195. The toner delivery system includes a toner adder roll that provides toner from the toner sump to the developer roll. A doctor blade provides a metered uniform layer of toner on the surface of the developer roll. PC unit 195 houses a photoconductive drum (PC drum) and may also include a waste toner removal system. Because imaging unit 192 is designed to carry both the developer unit 194 and the PC unit 195 it may also be referred to as an imaging basket 192. An exit port on toner cartridge 191 communicates with an entrance port on developer unit 194 allowing toner to be periodically transferred from toner cartridge 191 to resupply the toner sump in developer unit 194. The toner cartridge 191, imaging unit 192, developer unit 194 and PC unit 195 may be replaceable items for imaging device 102. Imaging unit 192 and toner cartridge 191 may each have a memory device 196 mounted thereon for providing component authentication and information such as type of unit, capacity, toner type, toner loading, pages printed, etc. Memory device 196 is illustrated as being in operative communication with controller 103 via communication link 143.

Controller 103 is also illustrated as being in communication, via communication link 143, with a controller 118 in option assembly 109. A controller 118 is typically provided within each option assembly 109 that is attached to imaging device 102. Controller 118 operates various motors housed within option assembly 109 that position media for feeding, feed media from media path branches PB into media path P or media path extensions PX, as well as, feed media along media path extensions PX. Controllers 103, 118 control the feeding of media along media path P and control the travel of media along media path P and media path extensions PX.

The electrophotographic imaging process is well known in the art and, therefore, will be only briefly described. During an imaging operation, laser scan unit 190 creates a latent image by discharging portions of the charged surface of the PC drum in PC unit 195. Toner is transferred from the toner sump in developer unit 194 to the latent image on the photoconductive drum by the developer roll to create a toned image. The toned image is then transferred either directly to a media sheet received in imaging unit 192 from one of media input trays 121 or to an intermediate transfer member and then to a media sheet. Next, the toned image is fused to the media sheet in fuser 193 and sent to an output location 133 or a duplexer 130. One or more gates 134, illustrated as being in operative communication with controller 103 via communication link 143, are used to direct the media sheet to output location 133 or to duplexer 134. Toner remnants are removed from the PC drum by the waste toner removal system that may be housed within PC unit 195. As toner is depleted from developer unit 194, toner is transferred from toner cartridge 191 into developer unit 194. Controller 103 coordinates these activities including media movement occurring during the imaging process or during finishing. For an imaging device 102 providing color images, four printer cartridges, one each for black, yellow, cyan, and magenta toners, would be used in imaging device 102 along with a corresponding plurality of developer and PC units.

Imaging device 102 and option assembly 109 each also include a media feed system 120 having a removable media input tray 121 for holding media M to be printed or scanned, a pick mechanism 122, a drive mechanism 123 positioned adjacent removable media input trays 121. Each media tray 121 also has a media dam assembly 124 and a feed roll assembly 125. In imaging device 102, pick mechanism 122 is mechanically coupled to drive mechanism 123 that is controlled by controller 103 via communication link 143. In option assembly 109, pick mechanism 122 is mechanically coupled to drive mechanism 123 that is controlled by controller 103 via controller 118 and communication link 143. In both imaging device 102 and option assembly 109, pick mechanisms 122 are illustrated in a position to drive a topmost media sheet from the media stack M into media dam 124 which directs the picked sheet into media path P or extension PX. Bottom feed media trays may also be used. As is known, media dam 124 may or may not contain one or more separator rolls and/or separator strips used to prevent shingled feeding of media from media stack M. Feed roll assemblies 125, comprised of two opposed rolls—a driven roll under control of controllers 103 and/or 118 and an idler roll, feed media from an inferior unit to a superior unit via a slot provided therein.

In imaging device 102, a media path P (shown in dashed line) is provided from removable media input tray 121 extending through print engine 104 to output area 133. An exit feed roll pair 135 driven by motor 136 that is in operative communication with controller 103 via communication link 143 may be provided to feed the media into output area 133. Media path P may also have extensions PX (shown in dashed line) and/or branches PB (shown in dotted line) from or to other removable media input trays as described herein such as those shown in option assembly 109. Media path P may include a multipurpose input tray 126 provided on the housing of imaging device 102 or may be incorporated into removable media tray 121 provided in imaging device 102 and a corresponding path branch PB that merges with the media path P within imaging device 102. Along media path P and its extensions PX are provided media position sensors 180-182 which are used to detect the position of the media, usually the leading and trailing edges of the media, as it moves along the media path P or path extension PX. Media position sensor 180 is located adjacent print engine 104 while media position sensors 181, 182 are positioned downstream from their respective media tray 121 along media path P or path extension PX. Media position sensor 180 also accommodates media fed along path branch PB from multipurpose media tray 126. Media position sensor 182 is illustrated at a position on path extension PX downstream of media tray 121 in option assembly 109. Additional media position sensors may be located throughout media path P and duplex path 131, when provided, and their positioning is a matter of design choice. Media position sensors 180-182 may be an optical interrupter or a limit switch or other type of edge detector as is known to a person of skill in the art and detect the leading and trailing edges of each sheet of media as it travels along the media path P, path branch PB, or path extension PX.

Media size sensors 183 are provided in image forming device 102 and each option assembly 109 to sense the size of media being fed from the removable media input trays 121. To determine media sizes such as Letter, A4, A6, Legal, etc., media size sensors 183 detect the location of adjustable trailing edge media supports and one or both adjustable media side edge media supports provided within removable media input trays 121 as is known in the art. Sensors 180-183 are shown in communication with controller 103 via communication link 144.

Separator 200 is mounted to the frame 160 of imaging device 102 and, as later explained in more detail, is used to move one of the developer unit 194 and the PC unit 195 between an operative or engaged position where the developer roll and PC drum form a contact nip along their respective axial lengths and a separated or lifted position where the developer roll and PC drum are spaced apart along at least of portion of their respective axial lengths.

Figure 2:
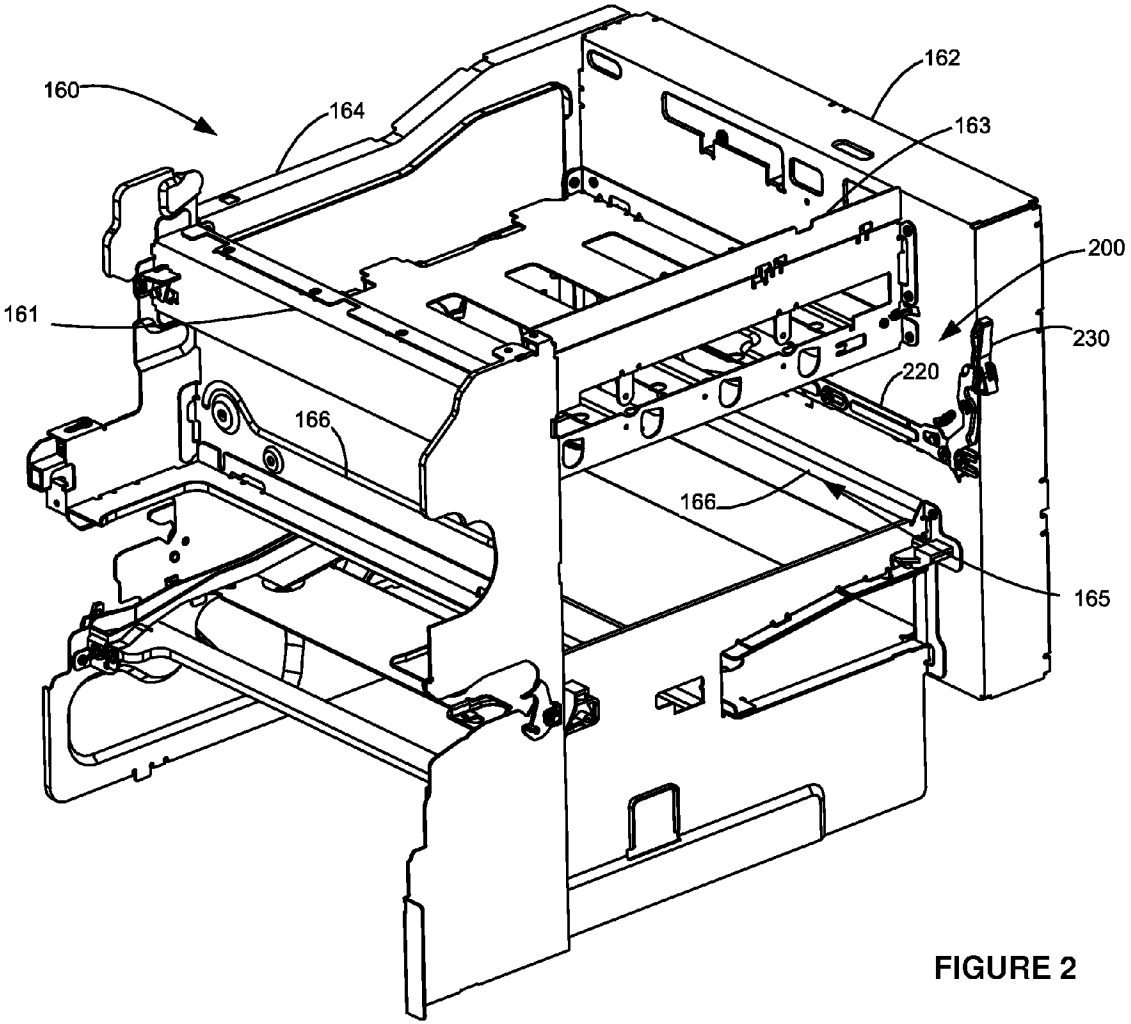
FIG. 2 is a perspective illustration of an example frame for an imaging device having an example separator of the present disclosure mounted thereon.

Referring to FIGS. 2-5, separator 200 is shown mounted to frame 160. In FIG. 2, frame 160 consists of four panels 161-164, designated for purposes of description and not limitation as opposed first and second panels 161, 162, and also referred to as, front and rear panels 161, 162, respectively, and opposed third and fourth panels 163, 164, also referred to as side panels 163, 164 or right and left side panels 163, 164, respectively. The opposed front and rear panels 161, 162 and left and right side panels 163, 164 form an opening 165 into which imaging unit 192 will be slidably inserted on rails 166 provided on front and rear panels 161, 162. Portions of separator 200 can be seen mounted to rear panel 162. Those portions include a release arm 230 and base link 220 mounted to rear panel 162 and first and second lift rails 260, 270 slidably mounted to right and left side panel 163, 164 (see FIG. 3). The other portions of separator 200 are obscured by the structure of the frame 160.

Figure 3:
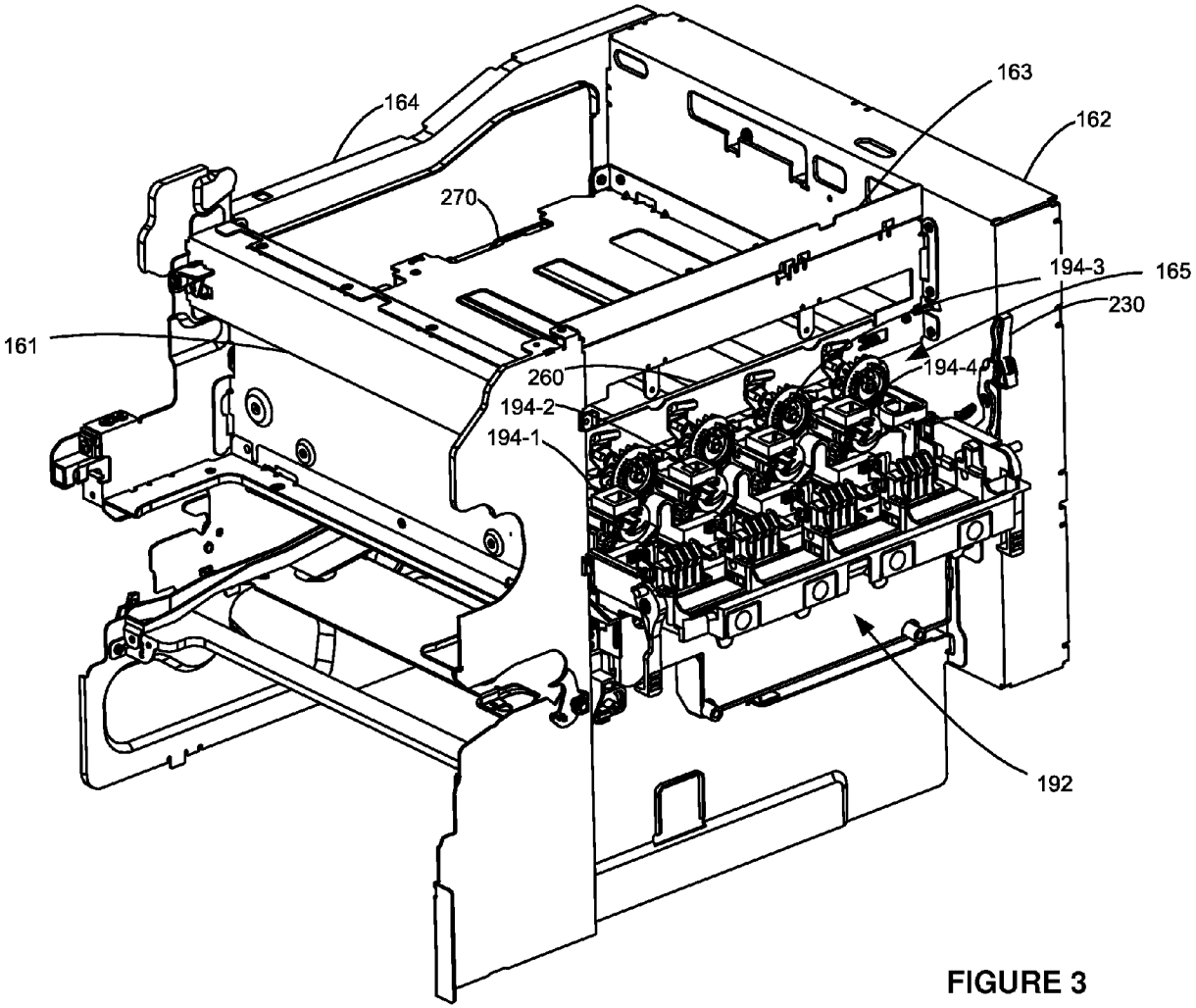
FIG. 3 is a perspective illustration of the frame of FIG. 2 having an imaging unit installed with the imaging unit having respective pluralities of developer units and PC units.
Figure 4:
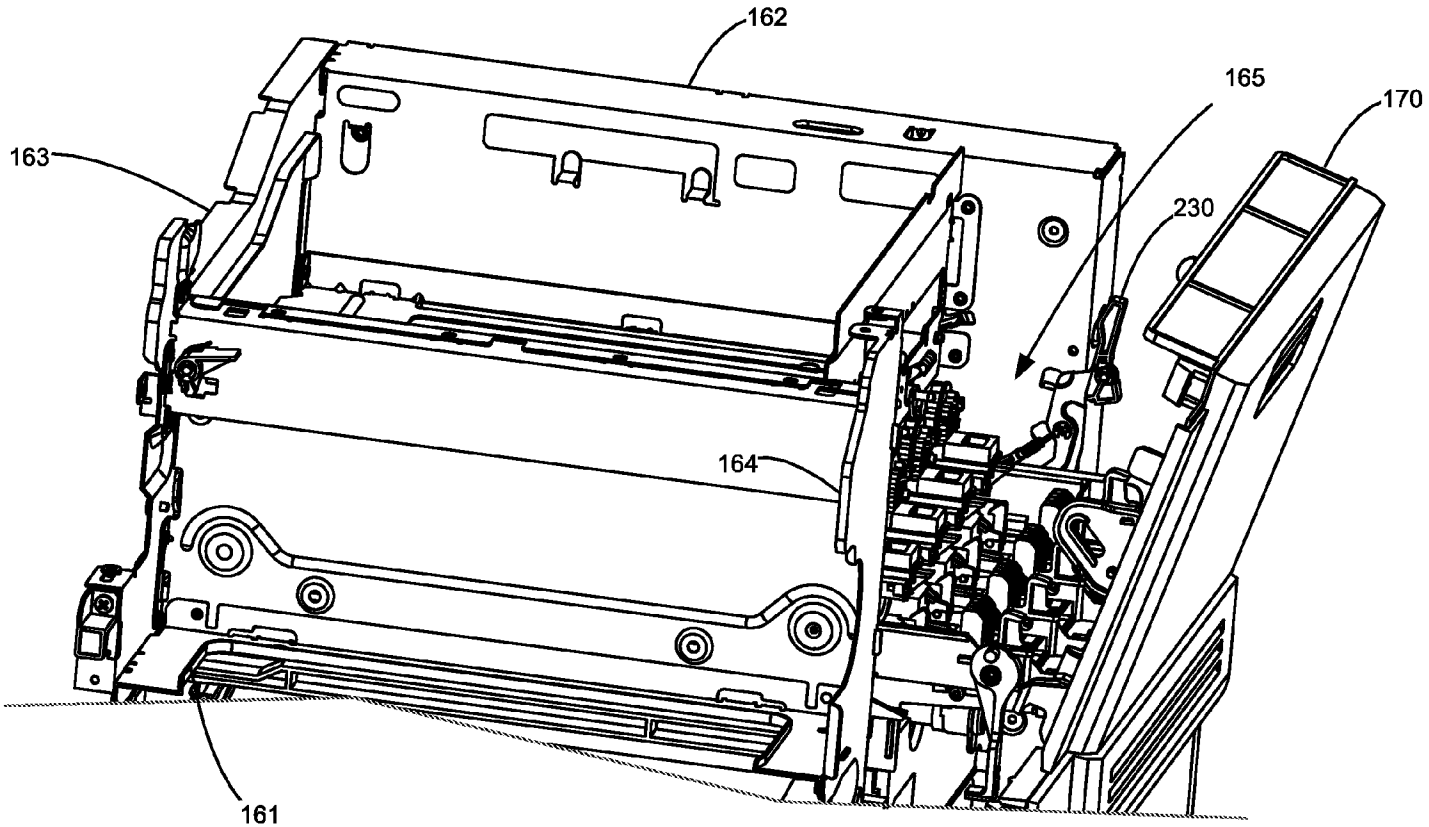
FIG. 4 is a partial perspective illustration of the frame of FIG. 2 showing an access door into the imaging unit.
Figure 5:
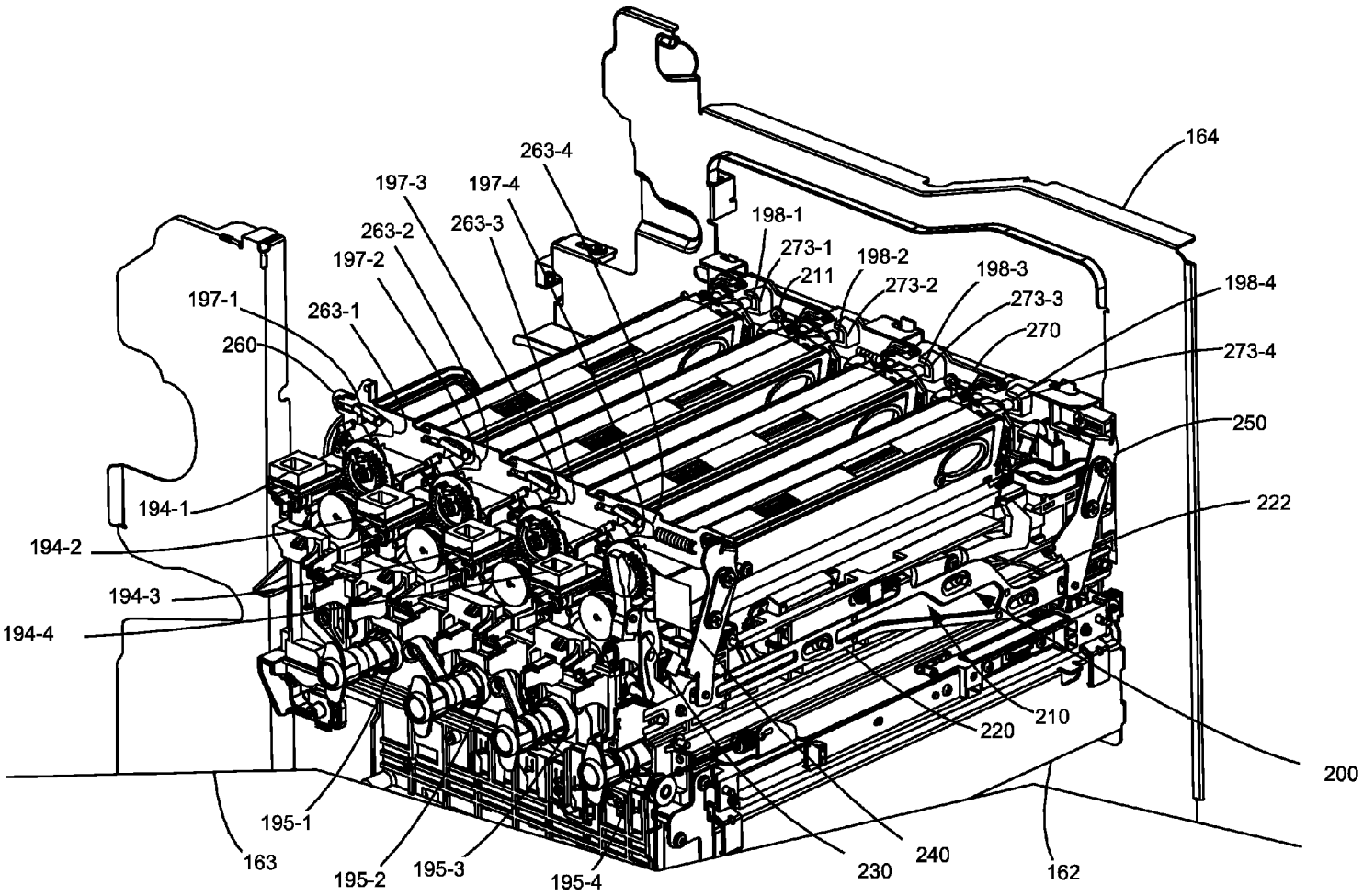
FIG. 5 is a partial perspective illustration of FIG. 3 with portions of the frame removed to show the components of the example separator of the present invention shown in FIG. 2 in relation to the imaging unit and its components.

In FIG. 3 imaging unit 192 has been inserted into opening 165 between front and rear panels 161, 162. Four developer units 194-1-194-4, from front to rear and their corresponding PC units 195-1-195-4, as better seen in FIG. 5, are present in imaging unit 192. For the illustrated arrangement, during shipment of imaging device 102, separator 200 would be used to move and retain the developer units 194-1-194-4 in a separated position with respect to their corresponding PC units 195-1-195-4. In FIG. 4, an access door 170, shown in a partially open position, spans opening 165. As will be described, a feature provided on access door 170 is used for operation of separator 200 and engages with release arm 230. As further explained with reference to FIGS. 15-17, access door 170 is used to release separator 200 from an engaged position where developer units 194-1-194-4 are in their separated positions to a released position where developer units 194-1-194-4 move into their operative position against their corresponding PC units 195-1-195-4 forming contact nips.

Figure 6:
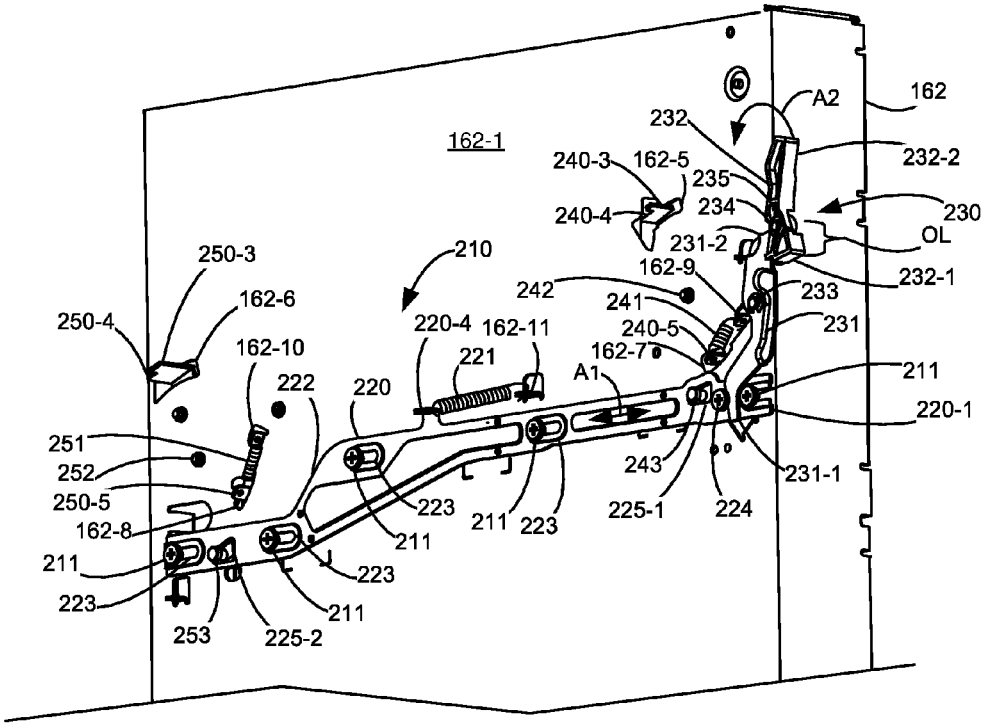
FIGS. 6-7 are partial perspective illustrations of the respective interior and exterior of a rear panel of the frame of FIG. 2 showing the mounting of a release linkage of the example separator of the present invention where
Figure 7:
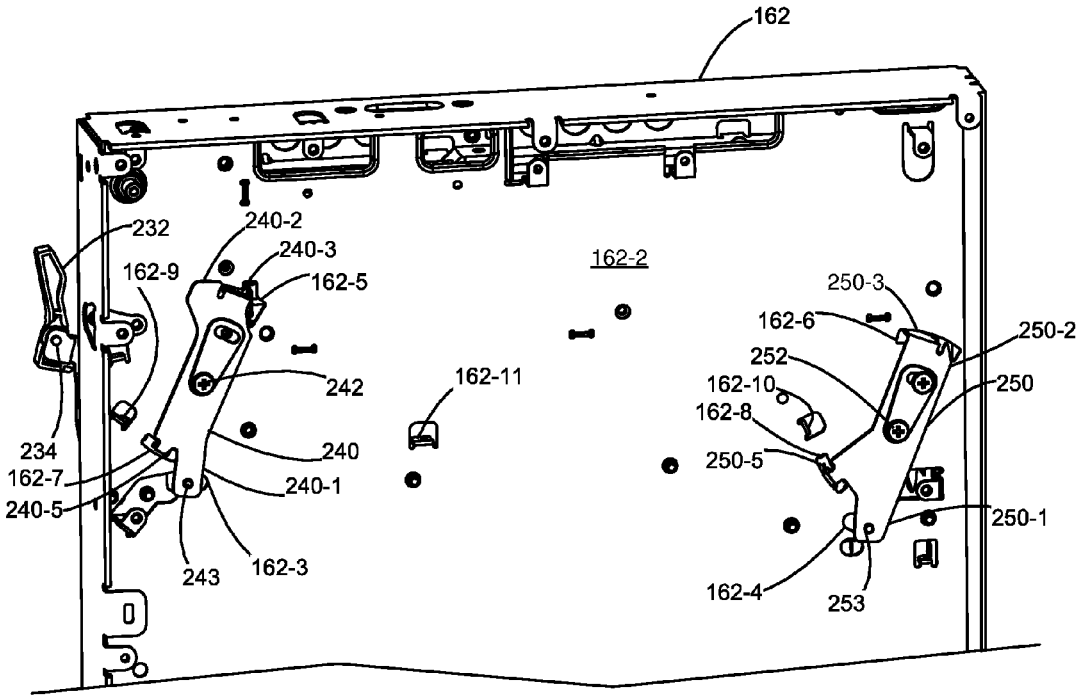

Referring to FIG. 5, front and rear panels 161, 162 and a portion of right panel 163 have been removed to illustrate the arrangement of the elements of the separator 200 with respect to the imaging unit 192. In FIG. 5, developer units 194-1-194-4 are shown in their operative or engaged position with their corresponding PC units 195-1-195-4, respectively. Separator 200 is shown in a released position. Separator 200 and its components are shown in more detail in FIG. 9-11. When the developer units are separated from their corresponding PC unit, separator 200 is said to be in an engaged position. First and second lift rails 260, 270 are respectively positioned at opposite ends of developer units 194-1-194-4, mounted on right and left panels 163, 164, and, are positioned substantially perpendicular to a release linkage 210 in a U-shaped arrangement. Included in release linkage 210 are a base linkage 220, a release arm 230, and first and second latch arms 240, 250. As shown in FIGS. 6-7, release linkage 210 is mounted on the rear panel 162.

The first and second lift rails 260, 270 each have a plurality of lift slots 263-1 263-4, 273-1-273-4 that receive corresponding lift members 197-1-197-4, 198-1-198-4 provided on the opposite ends of each of the developer units 194-1-194-4. Lift members 198-1-198-4 and second lift rail 270 are illustrated as being at an elevation that is lower than that of lift members 197-1-197-4 and first lift rail 260 to accommodate the insertion of imaging unit 192 into opening 165 in frame 160. Lift slots 263-1-263-4, 273-1-274-4 are provided with camming features used to raise and lower the developer units 194-1-194-4 and better seen on FIGS. 10-11.

Referring to FIGS. 6-7, release linkage 210 is mounted on the interior and exterior surfaces 162-1, 162-2 of rear panel 162. Base link 220 is shown in a horizontal position and slidably mounted on interior surface 162-1 of rear panel 162 using a plurality of screws 211 and corresponding slots 223. Base link 220 translates in the direction indicated by the double headed arrow A1. Because the first and second lift rails 260, 270 are at different heights, a downward jog 222 is provided in base link 220 to accommodate for this height difference. Depending from base link 220 are the release arm 230, and the first and second latch arms 240, 250. Release arm 230 is shown mounted to interior surface 162-1 of rear panel 162 while first and second latch arms 240, 250 are mounted to the exterior surface 162-2 of rear panel 162.

As shown in FIG. 6, release arm 230 is coupled to a first end 220-1 of base link 220 that as shown is adjacent to right panel 163. Release arm 230 has a first or bottom portion 231 and second or top portion 232 that are pivotally connected to one another. A first end 231-1 of first portion 231 is engaged with base link 220 at a screw 224 that is fastened to base link 220. A first pivot 233 is provided between first and second ends 231-1, 231-2 of first portion 231 on rear panel 162. A second pivot 234 is provided adjacent to the second end 231-2 of first portion 231. The second or top portion 232 of release arm 230 is mounted on pivot 234 at a location slightly above the first end 232-1 creating a small overlap OL between the first and second portions 231, 232 allowing the second portion 232 to pivot or fold toward base link 220 as indicated by arrow A2 but not pivot (to the right as viewed) beyond the illustrated extended position. An extension spring 235 (see inset in FIG. 8) is wrapped around second pivot 234 biasing the second portion 232 to be in the extended position as shown in FIG. 6.

Figure 8:
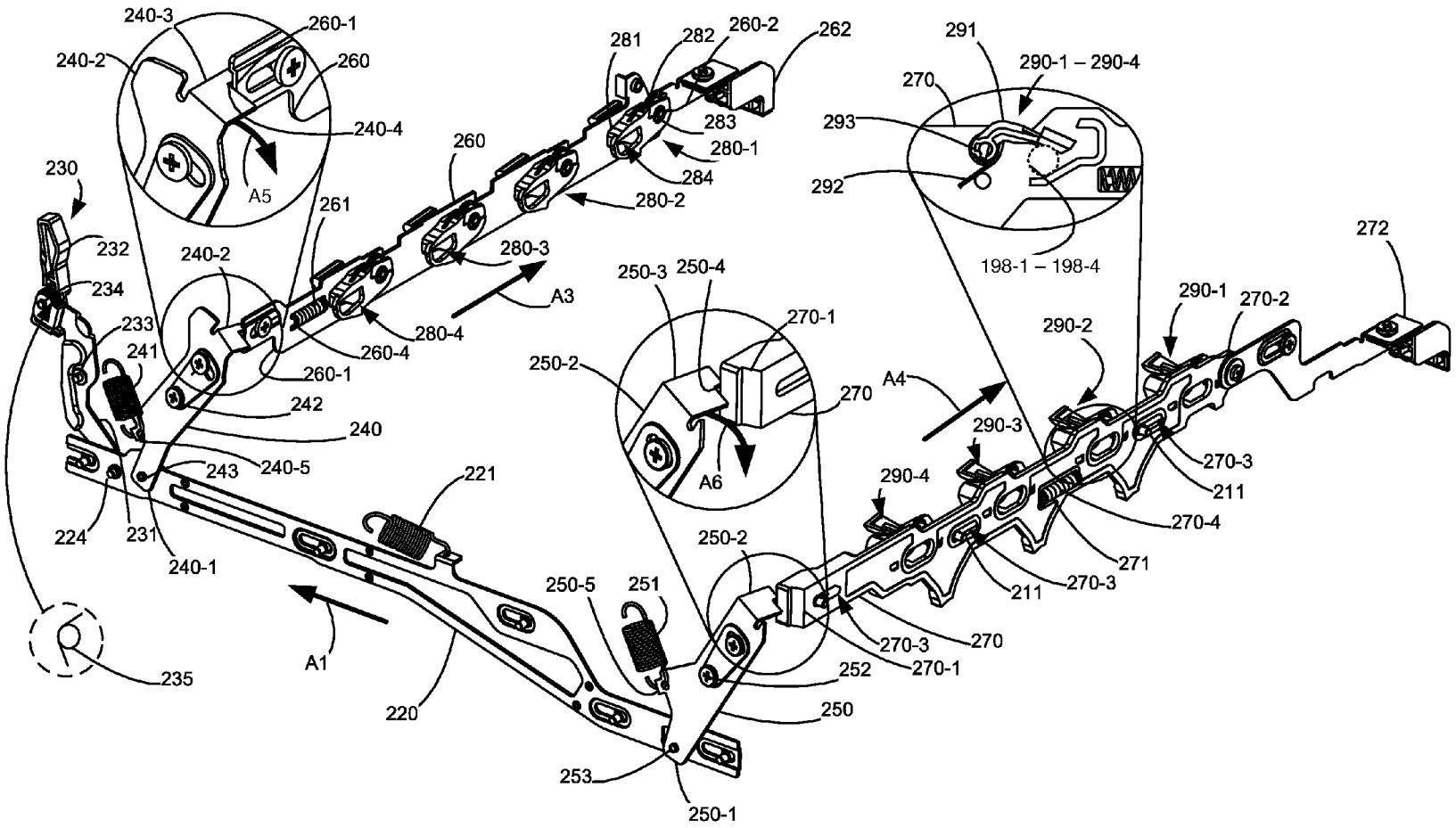
FIGS. 8-9 are perspective illustrations of the example separator of the present invention shown in an engaged position and a released position, respectively.

As shown in FIG. 7, first and second latch arms 240, 250 are pivotally mounted to rear panel 163 on pivots 242, 252. First and second latch arms 240, 250 are also mounted at their respective first ends 240-1, 250-1 to base link 220 using pins 243, 253 that extend through slots 162-3, 162-4, respectively, in rear panel 162 and through slots 225-1, 225-2, respectively, in base link 220. At their respective second ends 240-2, 250-2, first and second latch arms 240, 250 have latches portions 240-3, 250-3 for engaging with respective first ends 260-1, 270-1 of first and second lift rails 260, 270 as seen in FIG. 8. Latch portions 240-3, 250-3, extend through slots 162-5, 162-6 in rear panel 162. Latch portions 240-3, 250-3 each have a notch 240-4, 250-4 therein. Tabs 240-5, 250-5 are also provided on first and second latch arms 240, 250 between pivots 242, 252, and pins 243, 253, respectively. Tabs 240-5, 250-5 extend through slots 162-7, 162-8, respectively, in rear panel 162.

A spring 221 is attached at one end to base link 220 at tab 220-4 and at the other end to rear panel 162 at tab 162-11 as shown in FIG. 7. Similarly, springs 241, 251 are attached at one end to tabs 240-5, 250-5 on first and second latch arms 240, 250, respectively, and at their other ends to rear panel 162 at tabs 162-9, 162-10, respectively. Spring 241 applies a force to first latch arm 240 biasing it toward the first lift rail 260. Spring 251 similarly biases second latch arm 250 toward second lift rail 270. Spring 221 applies a return force to base link 220 after it has been translated (to the left as shown in FIG. 6) by the action of release arm 230.

Figure 9:
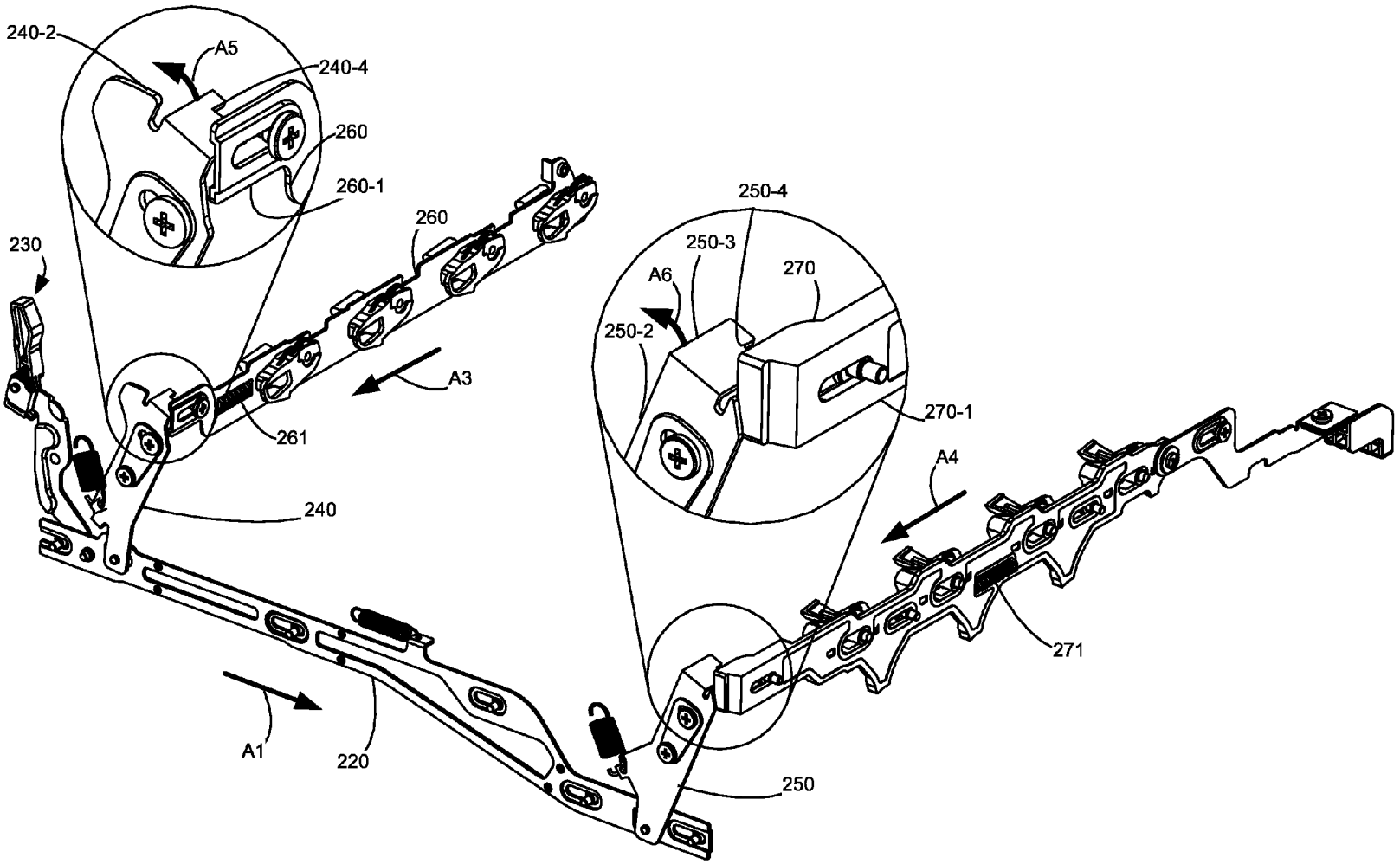
Figure 10:
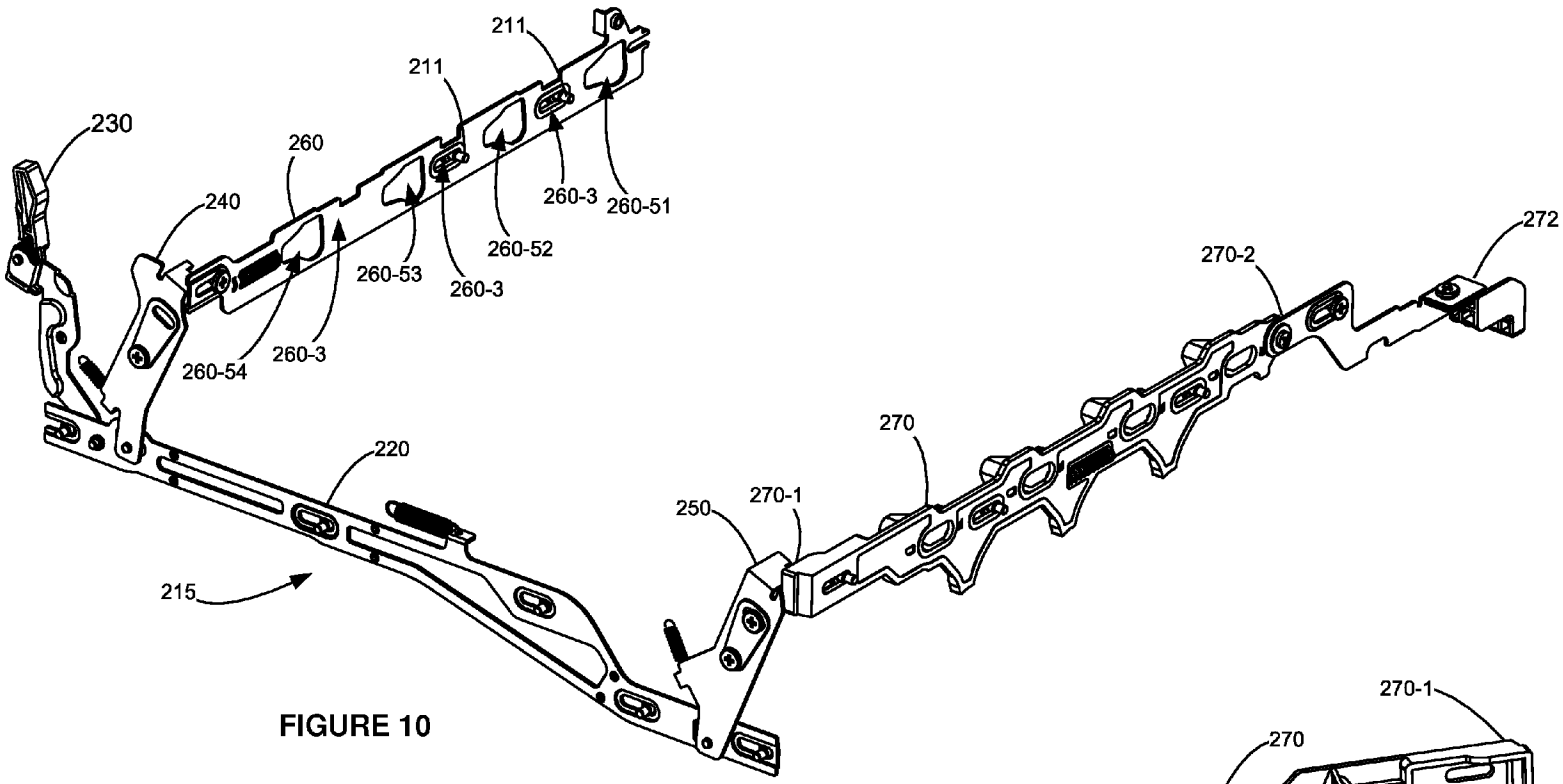
FIG. 10 is a perspective view of an alternative example separator of the present invention shown in a released position.
Figure 11:
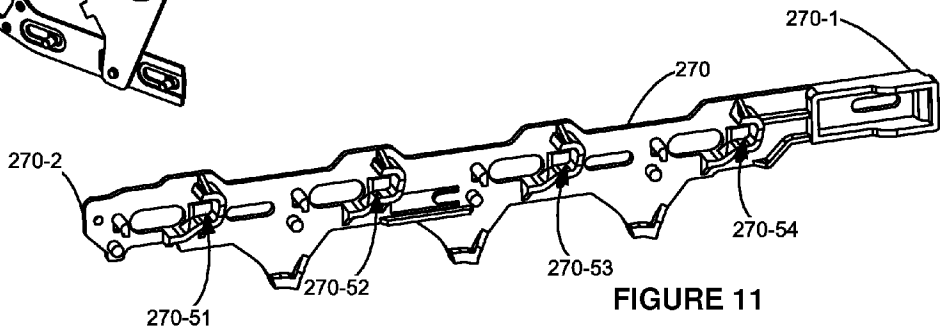
FIG. 11 is a perspective view of one of the lift rails used in the separator showing an example of open lift slots.

FIGS. 8-11 illustrate the components comprising separator 200. FIGS. 8-9 in the engaged and released positions, respectively. FIGS. 10-11 illustrates a simplified form of separator 200. To attain the engaged position with separator 200, first and second lift rails 260, 270 are pulled singly or jointly away from base link 220 as indicated by arrows A3, A4. Finger pulls 262, 272 may be provided at respective second ends 260-2, 270-2 of lift rails 260, 270 for this purpose. Finger pulls 262, 272 are used to place separator 200 in the engaged position prior to shipping or reshipping of imaging device 102. When the first lift rail 260 is pulled away from base link 220, the bias force from spring 241 pivots the first latch arm 240 about pivot 242 toward first lift rail 260 while pin 243 translates within slot 225-1 (see FIG. 6) allowing the latch portion 240-3 to engage at notch 240-4 with a first end 260-1 of lift rail 260. Notch 240-4 is provided in latch portion 240-3 to prevent over-pivoting of first latch arm 240 beyond the first end of first lift rail 260 and also provides an audible "click" as the first latch arm 240 snaps into engagement with first lift rail 260. Similarly when the second lift rail 270 is pulled away from base link 220, the bias force from spring 251 pivots the second latch arm 250 about pivot 252 toward second lift rail 270 while pin 253 translates within slot 225-2 allowing the latch portion 250-3 to engage at notch 250-4 with a first end 270-1 of lift rail 270.

Upon removal of the pulling force on the first lift rail 260, spring 261 provides a force to bias the first lift rail 260 against first latch arm 240. Spring 261 is mounted between right panel 163 and in a fingered-slot 260-4 provided in first lift rail 260. Spring 271 is mounted between left panel 164 and fingered-slot 270-4 provided in second lift rail 270 applying a force to second lift rail 270 to bias second lift rail 270 toward second latch arm 250. One or more mounting slots 260-3 (see FIG. 10), 270-3 are provided in first and second lift rails 260, 270 to allow them to be slidably attached using screws 211 the right and left panels 163, 164, respectively.

As better seen in FIGS. 10-11, each of first and second lift rails 260, 270 is provided with one or more lift slots, four lift slots 260-51-260-54 and 270-51-270-54 are shown in the first and second lift rails 260, 270, Lift slots 260-51-260-54 receive first members 197-1-197-4 and lift slots 270-51-270-54 receive second lift members 198-1-198-4 of developer units 194-1-194-4. As shown lift slots 260-51-260-54 are punched through first lift rail 260 which is made of metal, while lift slots 270-51-270-54 are molded as part of second lift rail 270 which is molded from plastic. The choice of materials used for first and second lift rails is a matter of design choice and not of limitation. The features of the lift slots are detailed in FIGS. 17-20.

Referring again to FIG. 8, one or more spring-biased bell cranks 280, 290 may be mounted on each of the first and second lift rails 260, 270, at each of the lift slots. Four bell cranks are mounted on first and second lift rails 260, 270, respectively, and provide a biasing force to the developer units 194-1-194-4 increasing the force on the contact nip between the developer roll and PC drum in PC units 195-1-195-4 formed when the developer units 194-1-194-4 and PC units 195-1-195-4 are in their respective operative positions. As shown bell cranks 280-1-280-4 are pivotally mounted on lift rail 260 adjacent to lift slots 260-51-260-54, respectively, and bell cranks 290-1-290-4 are pivotally mounted on second lift rail 270 adjacent to lift slots 270-51-270-54, respectively. Each of bell cranks 280-1-280-4 has a crank arm 281 and a bias spring 282 mounted on a pivot 283. Bell crank arm 281 has an opening 283 which receives a lift member, e.g. lift member 197-1 on developer unit 197. Bell cranks 290-1-290-4 have a different configuration. As shown in the inset, each has a crank arm 291 and a bias spring 292 mounted on a pivot 293. Here a free end of crank arm 291 applies the biasing force to lift members 198-1-198-4 indicated by the dotted circle. As shown in FIG. 10, bell cranks 280-1-280-4 and 290-1-290-4 are not required for the operation of separator 200 and are provided as a matter of design choice and not of limitation.

In FIG. 9, separator 200 is shown in the released position. Release arm 230 has been pulled to the left and base link 220 translated to the right as viewed in FIG. 9, pivoting first and second latch arms 240, 250 away from first and second lift rails 260, 270 allowing first and second lift rails to translate toward the base link 210 and rear panel 162. Because of springs 241, 251, latch portions 240-3, 250-3 of first and second latch arms 240, 250, respectively, are biased against the sides of first and second lift rails 260, 270.

Figure 12:
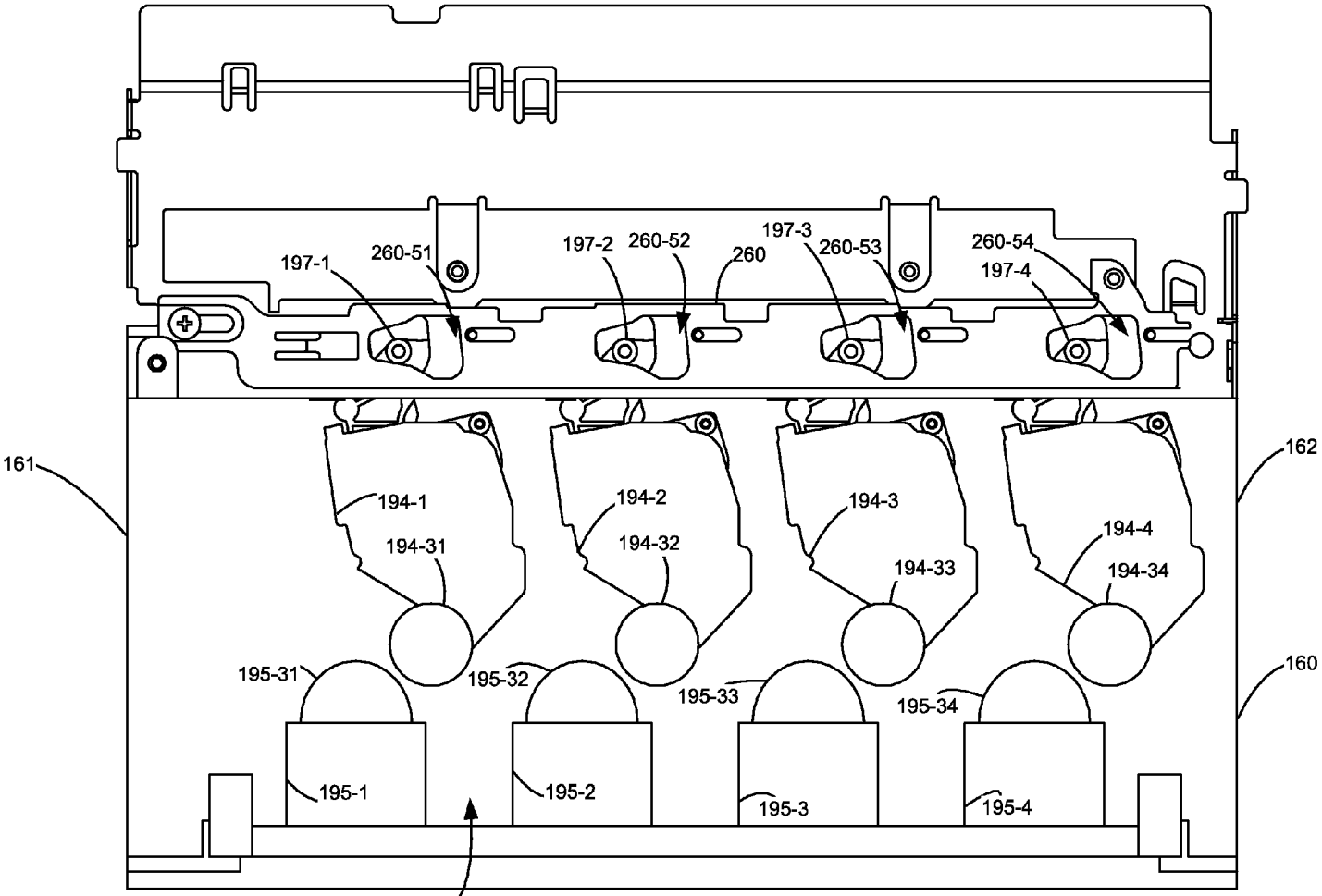
FIGS. 12-13 are elevational illustrations respectively showing the developer units in a lifted or separated position and in the operative position with respect to their corresponding PC units contained within the imaging basket where the developer and PC units and imaging basket are schematically depicted.
Figure 13:
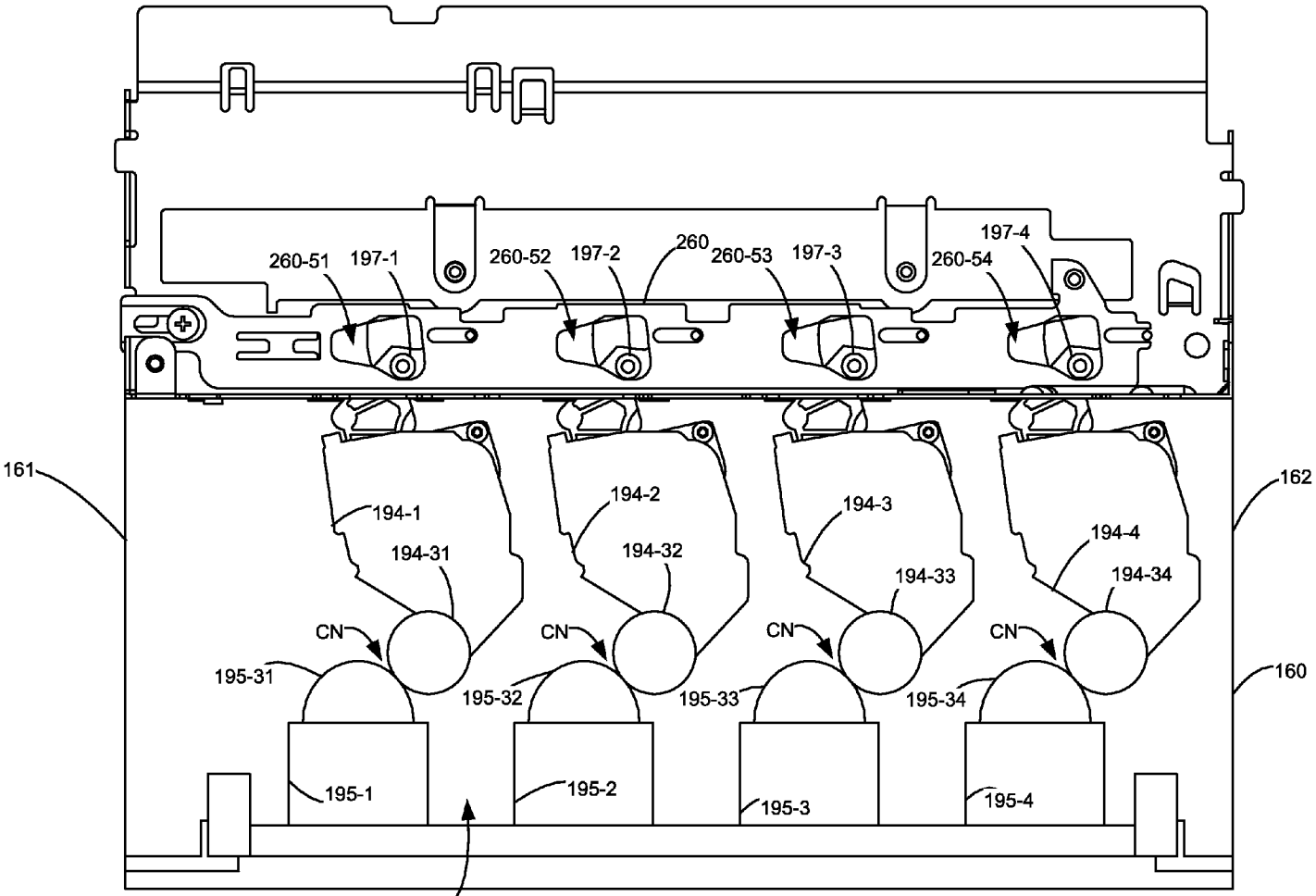
Figure 14:
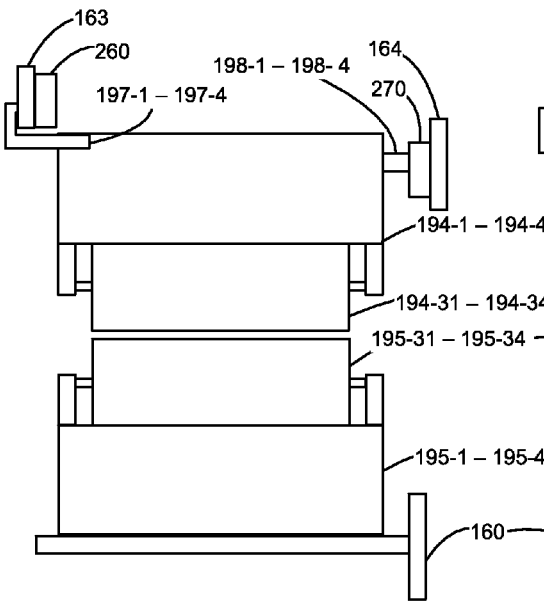
FIGS. 14-17 are schematic illustrations showing operative and separated positions of a developer unit and its corresponding PC unit where
Figure 15:
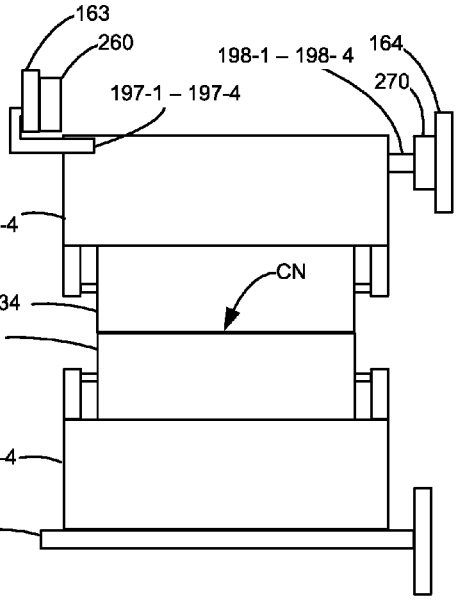

Referring now to FIGS. 12-17 schematically show the operation of separator 200 when used in imaging unit 192 having developer units 194-1-194-4 and PC units 195-1-195-4 therein. With separator 200 in the engaged position shown in FIG. 8, the developer rolls 194-31-194-34 of developer units 194-1-194-4 would be separated from the corresponding PC drums 195-31-195-34 of PC units 195-1-195-4 when imaging unit 192 is installed in frame 160 as shown in FIGS. 12 and 14. As can been seen in FIG. 12, the lift members 197-1-197-4 of developer units 194-1-194-4 are positioned within a higher portion of respective lift slots 260-51-260-54 of first lift rail 260. With separator 200 in the released position shown in FIG. 9, the developer rolls 194-31-194-34 would be in the operative position and contacting the corresponding PC drums 195-31-195-34 along their respective axial lengths forming a contact nip, designated CN, as shown in FIGS. 13 and 15. As can been seen in FIG. 13, the lift members 197-1-197-4 of developer units 194-1-194-4 have translated to a lower portion of respective lift slots 260-51-260-54 of first lift rail 260.

Figure 16:
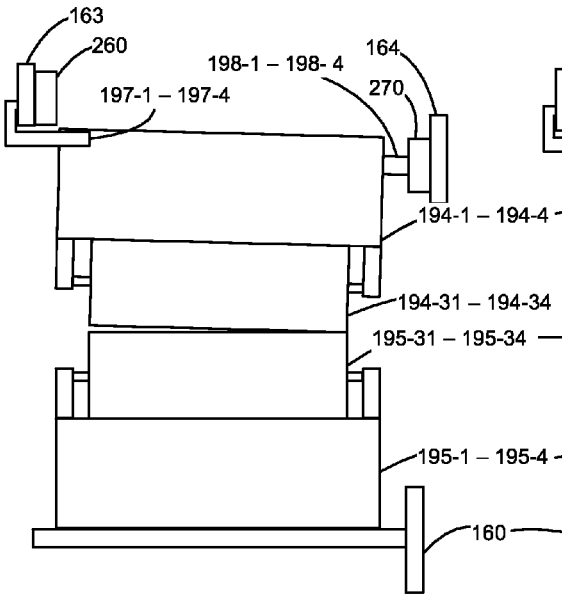
Figure 17:
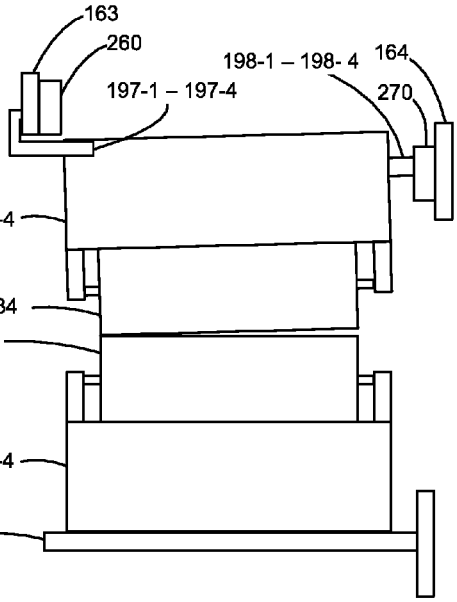

As previously described, each of lift rails 260, 270 may be independently pulled away from first and second latch arms 240, 250 respectively, resulting in one end of the developer unit between separated from its corresponding PC unit. FIG. 16 illustrates the separation between developer rolls 194-31-194-34 and PC drums 195-31-195-34 when first latch arm 240 is engaged with the first end 260-1 of first lift rail 260 while second latch arm 250 is not engaged with the first end 270-1 of second lift rail 270. As can be seen developer rolls 194-31-194-34 and PC drums 195-31-195-34 are separated along a substantial portion of their axial lengths except for a short portion adjacent to second lift rail 270. FIG. 17 illustrates the separation between developer rolls 194-31-194-34 and PC drums 195-31-195-34 when first latch arm 240 is not engaged with the first end 260-1 of first lift rail 260 while second latch arm 250 is engaged with the first end 270-1 of second lift rail 270. Similarly, developer rolls 194-31-194-34 and PC drums 195-31-195-34 are separated along a substantial portion of their axial lengths except for a short portion adjacent to first lift rail 260. Such alternate engagement/disengagement of first and second latch arms 240, 250 may be used where imaging device is being reshipped. Alternatively only one lift rail and latch arm may be provided in separator 200 so that developer rolls 194-31-194-34 and PC drums 195-31-195-34 are separated along the majority of their respective axial lengths.

As described, separator 200 in the engaged position separates the developer unit from the PC unit and in the released condition moves the two units in contact with one another along their respective developer rolls and PC drums. Lift slots 260-51-260-54 and 270-51-54 provide this function. Referring to FIGS. 18-21 operation of the lifts slot is shown for generic components where separation is desired for the reasons previously stated. Lift slot S is a generalized lift slot that is illustrative of lift slots 260-51-260-54 and 270-51-270-54. Lift rail LR represents lift rail 260 or lift rail 270. Frame panel FP represents that portion of the frame toward which lift rail LR is biased by the biasing force Fb provided by the lift rail biasing spring, such as spring 261 or spring 271, while force Fs represents the force needed to overcome force Fb and slide or translate lift rail LR away from frame panel FP to allow latch L to be engaged between frame panel FP and lift rail LR. Latch L represents the latch portion of a latch arm, such as first or second latch arms, 240, 250. Lift member LM represents the lift member or members, such as lift members 197-11, 198-11, provided on the developer unit or on a PC unit. As shown, the bottom B, of slot S has first and second portions P1, P2 interconnected by a camming surface CS. Second portion P2 of bottom B is illustrated as being vertically offset from the first portion P1.

Figure 18:
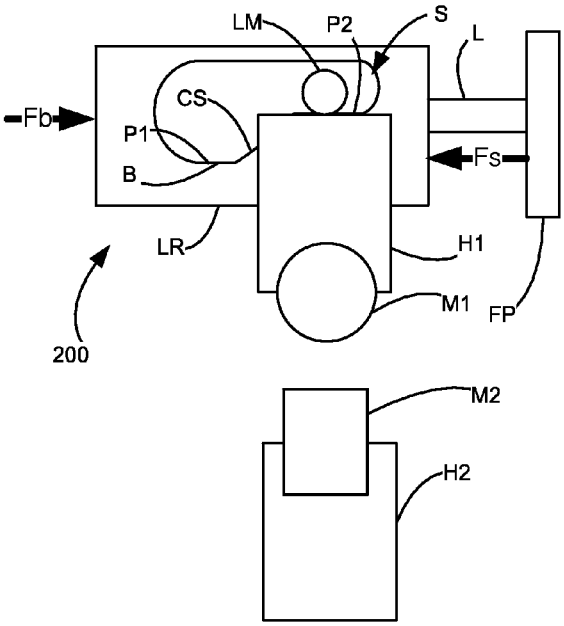
FIGS. 18-19 schematically illustrate the lift slots provided in the lift rails of the separator and respective separation and engagement of two generic electrophotographic units within an imaging device where the separator is used to move the upper unit.

FIG. 18 schematically depicts separator 200 in an engaged position lifting an upper housing H1 having a first member M1, illustrated as a roll, away from a lower housing H2 have a second member M2, illustrated as a flat plate. Housing H1 and member M1 may represent a developer unit while housing H2 and member M2 may represent a PC unit or a belt. First and second members M1, M2 need not be rolls. For example, first member M1 may be a roll while second member M2 may be a belt or plate. Lift member LM is on second portion P2 of the bottom B of lift slot S. Viewing FIG. 19, separator 200 is in the released position and latch L has been removed from between lift rail LR and frame panel FP. Lift member LM has transitioned down camming surface CS and is on or adjacent to first portion P1 of the bottom of lift slot S as indicated by the solid and dashed line versions of lift member LM. It will be recognized that whether or not lift member rests on first portion P1 of the bottom B depends on the type and force of contact between members M1 and M2, their respective dimensions as compared to the height difference between first and second portions P1, P2 of lift slot S.

Figure 19:
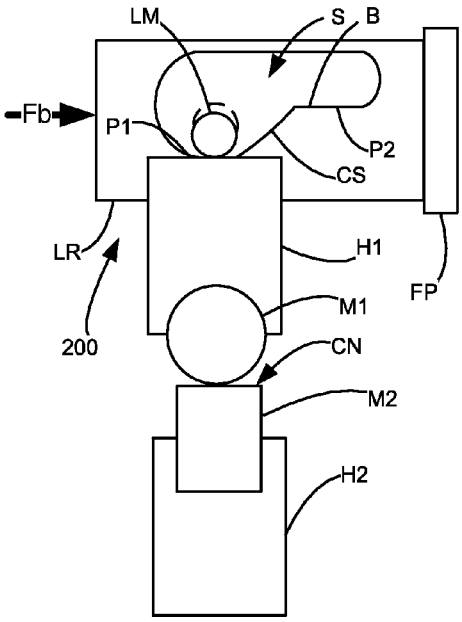
Figure 20:
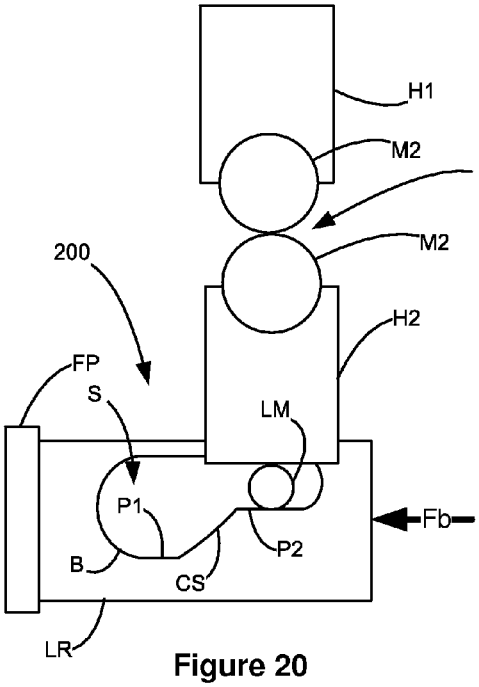
FIGS. 20-21 schematically illustrate the respective separation and engagement of two generic electrographic units within an imaging device where the separator is used to move on the lower unit.
Figure 21:
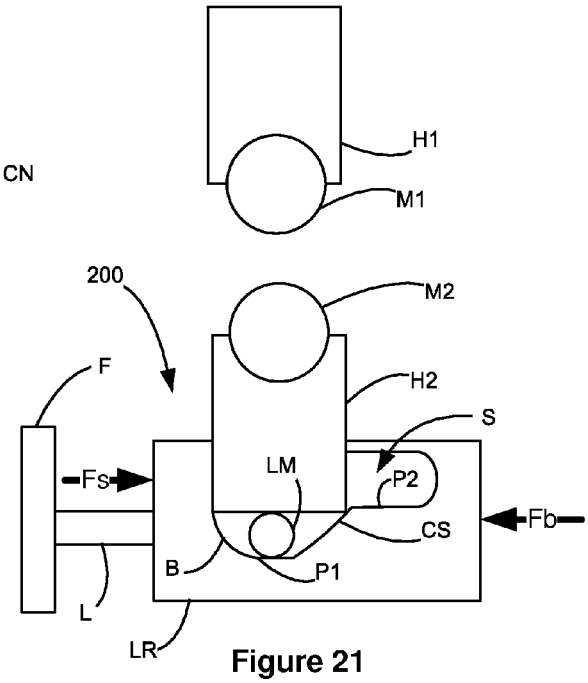

In FIGS. 20 and 21, elements carry the same reference designations as those used in FIGS. 18 and 19. However in FIG. 20, separator 200 in the released state now raises the lower housing H2 and member M2 into contact with member M1 on housing H1. There lift member LM is on the second portion P2 of the bottom B of slot S when separator 200 is in the released position instead of the engaged position. In FIG. 21, separator 200 is shown in the engaged position with latch L now positioned between lift rail LR and frame panel FP. Lift member LM has transitioned down camming surface CS, and, is on or may be adjacent to first portion P1 of the bottom of lift slot S. Thus separator 200 may be used on either housing H1 or H2.

Figure 22:
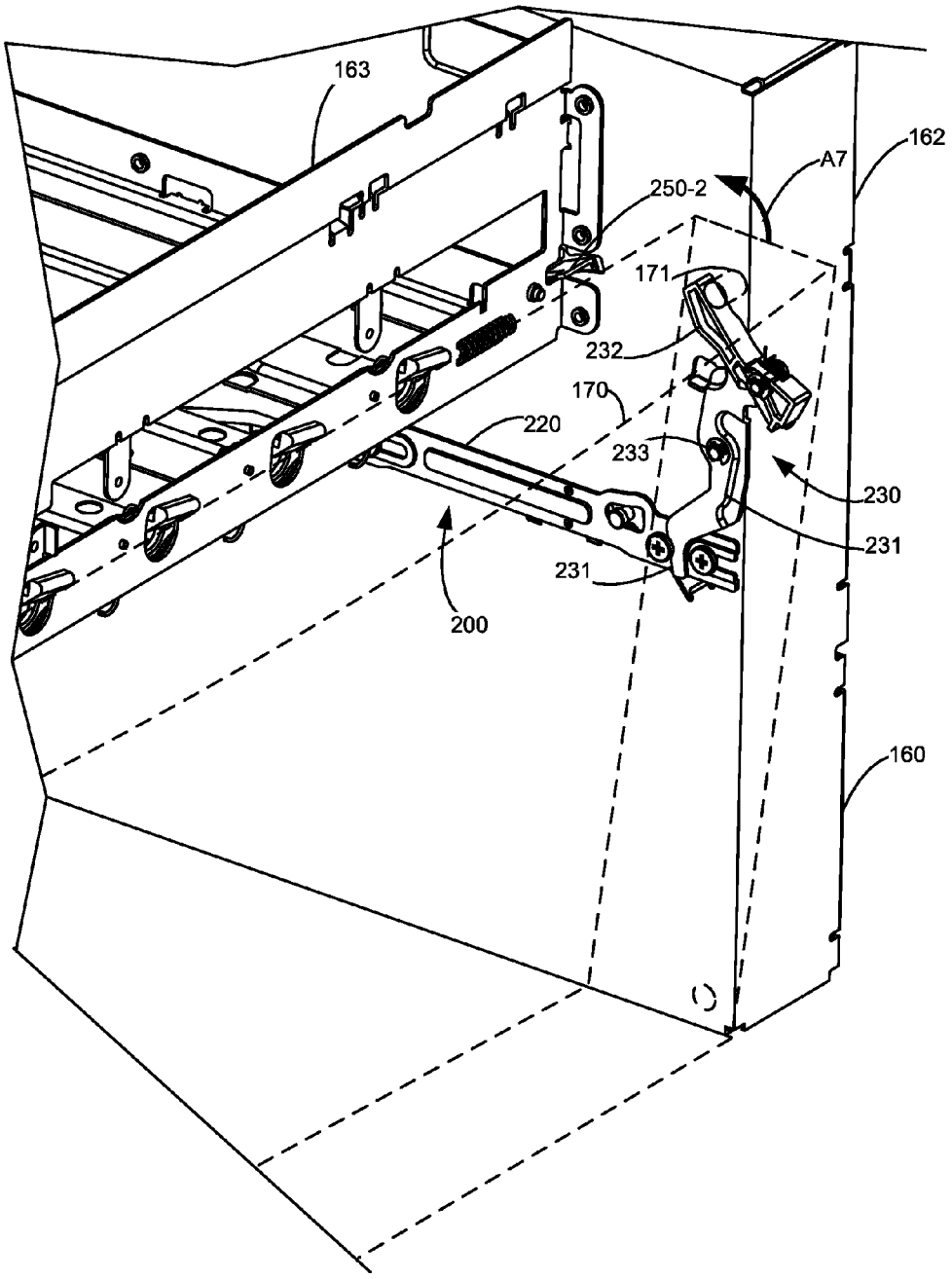
Figure 23:
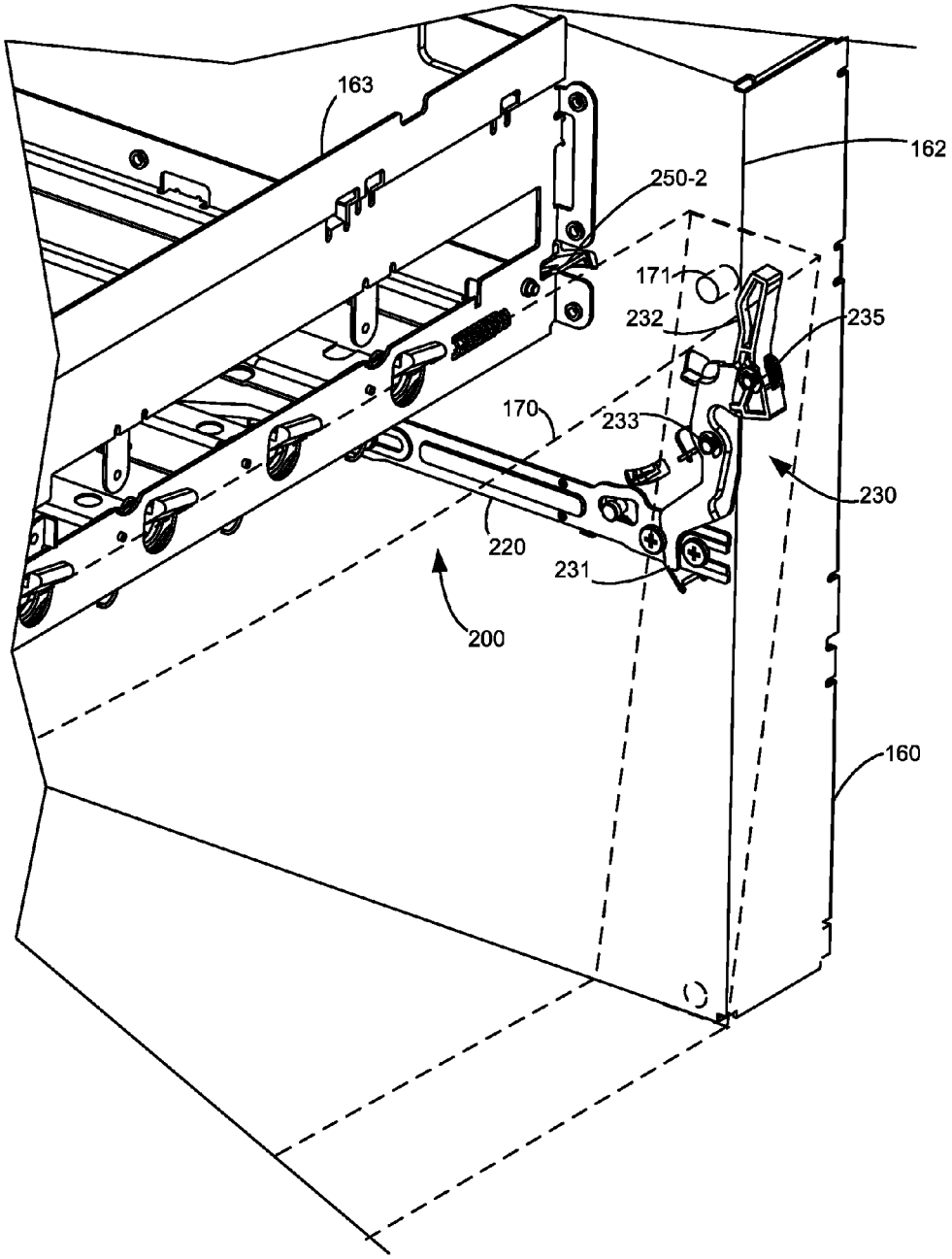
Figure 24:
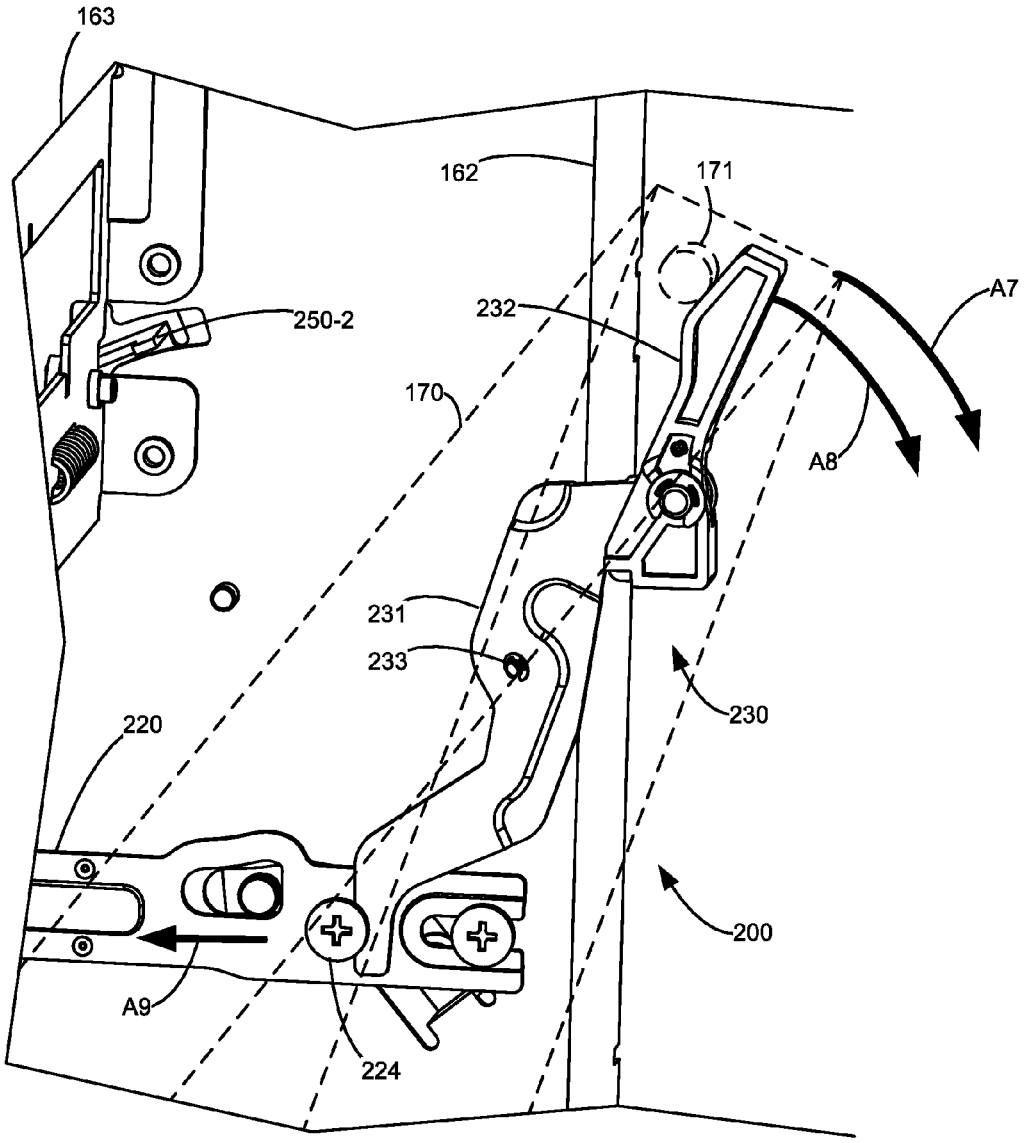

Referring now to FIGS. 22-24, actuation of separator 200 will be described. In FIG. 22, separator 200 has been placed in the engaged position by sliding one or both lift rails away from base link 220 or rear panel 162. This is the state used for shipping or reshipping of imaging device 102. The second portion 232 of release arm 230 is shown folding due to the contact with actuation member 171 mounted on access door 170 as access door 170 is moved to a closed position on frame 160. This folding action of release arm 230 allows separator 200 to remain in the engaged position. In FIG. 23, access door 170 has reached its closed position and actuation member 171 is in a position behind the upper portion 232 of release arm 230. The separator 200 remains in the engaged position and base link 220 has not moved. The second portion 232 of release arm 230 has returned to its extended position due to the action of spring 235. In FIG. 24, access door 170 is shown in the open position. Actuation member 171 has engaged the second portion 232 of release arm 30 causing it to pivot around pivot 242. First end 231 pushes against screw 224 mounted in base link 220, translating base link 220 toward to the left as shown, which causes first and second latch arms to pivot away from first and second lift rails 260, 270, placing separator in the release state as shown in FIG. 9 and the developer units 194-1-194-4 and PC units 195-1-195-4 into their operative positions. Subsequent closing and opening of access door 170 does not return separator 200 to the engaged position. To return separator 200 to the engaged position one or both lift rails need to be pulled away from rear panel 162 as previously described. Because separator 200 is installed in imaging device 102 and may be reset when needed, the drawbacks of the prior art are avoided.

The foregoing description of embodiments has been presented for purposes of illustration. It is not intended to be exhaustive or to limit the present disclosure to the precise steps and/or forms disclosed, and obviously many modifications and variations are possible in light of the above teaching. It is intended that the scope of the invention be defined by the claims appended hereto.

What is claimed is:

1. An electrophotographic imaging device, comprising:

a frame having an opposed first and a second panel connected with an opposed third and a fourth panel;

an access door pivotally mounted between the first and the second panels and adjacent to one of the third and the fourth panels and moveable between an open position and a closed position with respect to the frame;

an actuation member coupled to the access door;

a developer unit having a developer roll rotatably mounted therein;

a photoconductor (PC) unit having a PC drum rotatably mounted therein;

the developer unit and PC unit being insertable through the access door between the first and second panels and supported by the frame;

a first lift member mounted on an end of one of the developer unit and the PC unit; and, a separator for moving one of the developer unit and the PC unit between an operative position at which the PC drum and the developer roll form a contact nip along their respective axial lengths, and a separated position whereat the PC drum and the developer roll are spaced apart along at least a portion of their respective axial lengths, the separator comprising:

a first lift rail slidably mounted on one of the third panel and the fourth panel and having at least one lift slot therein aligned with and receiving the first lift member therein when the one of the developer unit and the PC unit are inserted into the frame, the at least one lift slot having a bottom having a first portion and a second portion offset from one another with a camming portion therebetween;

a first lift rail spring coupled to the first lift rail and to the one of the third and the fourth panels to which the first lift rail is mounted; the first lift rail spring biasing the first lift rail into a biased position;

and, a release linkage having:

a base link slidably attached to one of the first and second panels;

a release arm pivotally mounted to the one of the first and second panels to which the base link is attached and coupled to the base link, the release arm engageable with the actuation member;

a first latch arm pivotally mounted to the one of the first and second panels to which the base link is attached and pivotally coupled to the base link;

a first latch-arm spring coupled between the first latch arm and the one of the first and second panels to which the base link is attached for biasing the first latch arm toward the first lift rail; and, the first latch arm having a latch portion, the latch portion engaging the first lift rail when the first lift rail is moved away from its biased position and holding the first lift rail away its biased position, wherein, when the first lift member is in one of the first and second portions of the at least one lift slot and the latch portion of the first latch arm is not engaged with the first lift rail, the one of the developer unit and the PC unit is the operative position with respect to the other of the developer unit and PC unit, and, when the first lift member is in the other of the first and second portions of the at least one lift slot and the first rail is engaged with the latch portion of the first latch arm, the one of the developer roll unit and the PC unit is in the separated position with respect to the other of the developer roll and the PC unit;

wherein, with one of the developer unit and the PC unit in the separated position, the latch portion of the first latch arm being engaged with the first lift rail and the access door in the closed position, on opening of the access door, the actuation member engages the release arm pivoting the release arm, translating the base link, pivoting the first latch arm and disengaging the latch portion of the first latch arm from the first lift rail, allowing the first lift rail to return to its biased position, moving the at least one lift slot so that the first lift member travels along the camming portion to the other of the first and second portions and moving the one of the developer unit and the PC unit into the operative position.

2. The imaging device of claim 1 further comprising:

the one of the developer unit and the PC unit having the first lift member has a second lift member mounted on an end opposite to the first lift member;

a second lift rail slidably mounted on the other of the third and the fourth panels having at least one lift slot therein aligned with and receiving the second lift member therein when the one of the developer unit and the PC unit are inserted into the frame, the at least one lift slot of the second lift rail having a bottom having a first portion and a second portion offset from one another with a camming portion therebetween;

a second lift-rail spring coupled to the second lift rail and to the other of the third and the fourth panels for biasing the second lift rail to a biased position; and, the release linkage further comprising:

a second latch arm pivotally mountable to the one of the first and second panels to which the first latch arm is mounted and pivotally attached to the base link;

a second latch-arm spring coupled between the second latch arm and the one of the first and second panels to which the base link is attached for biasing the second latch arm toward the second lift rail; and, the second latch arm having a latch portion engaging the second lift rail when the second lift rail is moved away its biased positioned and holding the second lift rail away from its biased position, wherein, when both the first and second lift members are both in a respective one of the first and second portions of their respective at least one lift slots and the first and second lift rails are in their respective biased positions, the one of the developer unit and the PC unit is the operative position, and, when both of the first and second lift members are in the respective other of the first and second portions of their respective at least one lift slots and the latch portions of the first and second latch arms are engaged with the first and second lift rails, respectively, and the one of the developer unit and the PC unit is in the separated position.

3. The imaging device claim 2 further comprising a first and a second spring-biased bell crank pivotally mounted on the first and the second lift rails, respectively, a respective end of the first and the second bell crank positioned adjacent to the one of the first and second portions of the at least one lift slots in the first and the second lift rails, respectively, the first and second bell cranks applying a biasing force to the first and the second lift members, respectively, to increase a contact force between the developer roll and the PC drum when the developer unit and the PC unit are in the operative position.

4. The imaging device of claim 1 wherein the developer unit comprises four developer units and the PC unit comprises four PC units, the first lift member comprises four first lift members mounted on a respective ones of the four developer units and the four PC units, and the first lift railing having the at least one lift slot comprises four lift slots, each lift slot receiving a respective one of the four first lift members.

5. The imaging device of claim 1 wherein a return spring is coupled between the base link and the one of the first and second panels to which the base link is attached for biasing the base link away from the first lift rail.

6. The imaging device of claim 1 wherein the release arm includes a first portion and a second portion, the first portion pivotally mounted to the one of the first and second panels to which the base link is attached, one end of the first portion coupled to the base link, the second portion being pivotally mounted to the other end of the first portion, an extension spring coupled to the first and second portions to bias the second portion to an extended position, wherein the second portion is engageable with the actuation member and moves to a folded position when the actuation member encounters the release arm on the closing of the access door so that the base link remains in place and then returns to the extended position when the access door has reach a closed position, and, upon opening of the access door, the actuation member engages the release arm, pivoting the release arm, translating the base link thereby releasing the latch portion of the first latch arm from engagement with the first lift rail allowing the first lift rail to return to its biased position.

7. The imaging device of claim 1 wherein the first lift rail has a pull thereon for translating the first lift rail away from its biased position and allowing the latch portion of the first latch arm to reengage with the first lift rail thereby separating the developer roll and the PC drum along a portion of their respective axial lengths.

8. An electrophotographic imaging device, comprising:

A frame having a rear panel, a front panel, a left and a right panel;

an access door mounted between the front and rear panel, the access door pivotally mounted and moveable between an open position and a closed position with respect to the frame, the access door having an actuation post mounted thereon adjacent to the rear panel;

an imaging unit slidably insertable through the access door and supported by the front and rear panels, the imaging unit holding at least one PC unit having a PC drum rotatably mounted therein and at least one developer unit having a left and a right lift member on respective left and right ends of the developer unit and a developer roll rotatably mounted therein, the at least one developer unit movable between an operative position where the developer roll and PC drum form a contact nip along their respective axial lengths and a separated position where the developer roll is spaced apart from the PC drum along a portion of their respective axial lengths; and, a reusable separator for moving the at least one developer unit between the operative and separated positions, the separator comprising:

a left lift rail slidably mounted on the left panel, the left lift rail having at least one lift slot therein aligned with and receiving the left lift member therein when the imaging unit is inserted into the frame;

a right lift rail slidably mounted on the right panel, the right lift rail having at least one lift slot therein aligned with and receiving the right lift member therein when the imaging unit is inserted into the frame;

a left and a right lift-rail spring between the left and the right lift rails and the left and the right panels, respectively, for biasing the left and the right lift rails to respective biased positions adjacent to the rear panel;

each at least one lift slot in the left and the right lift rails having a bottom having a first portion and a second portion vertically offset from one another with a camming portion therebetween; each at least one lift slot sized to receive the corresponding lift member; and, a release linkage having:

a base link slidably attached to the rear panel;

a release arm pivotally mounted to the rear panel and pivotally attached to the base member, the release arm engageable with the actuation post;

a left and a right latch arm pivotally each pivotally mounted to the frame adjacent to the left and right lift rails, respectively, the left and the right latch arms each pivotally attached to the base link;

a left and a right latch-arm spring coupled between the left and the right latch arms, respectively, and the rear panel for biasing the left and the right latch arms toward the left and the right lift rails, respectively; and, each latch arm having a latch portion engaging the respective lift rail when the respective lift rail is moved away its biased position and holding the respective lift rail away from its biased position, wherein, when the left and the right lift members are both in one of the first and the second portions of their respective lift slots and the left and the right lift rails in their respective biased positions, the developer unit is the operative position, and, when the left and the right lift members are both in the other of the first and the second portions of their respective lift slots and the left and the right latch arms are engaged with the left and the right lift rails, respectively, and the developer unit is in the separated position;

wherein with the at least one developer unit in the separated position and the left and the right latch arms engaged with the left and the right lift rails, respectively, and the access door in the closed position, on opening of the access door, the actuation post engages the release arm pivoting the release arm, translating the base link, pivoting the left and the right latch arms and disengaging them from the left and the right lift rails allowing the left and the right lift rails to return to their respective biased positions and moving the respective at least one lift slots in each of the left and the right lift rails so that the left and right lift posts travel along the respective camming portions to the other of the first and second portions moving the at least developer unit into the operative position with the at least one PC unit.

9. The imaging device of claim 8 wherein a return spring is coupled between the base member and the rear panel for biasing the left and the right latch arms toward their respective left and right lift rails.

10. The imaging device of claim 9 wherein a portion of the release arm that is engageable with the actuation post is moveable when the actuation post encounters the release arm on the closing of the access door so that the release arm does not translate the base link.

11. The imaging device of claim 10 wherein the portion of the release arm that is engageable with the actuation post moves to folded position when engaged with the actuation post on the closing of the access door and returns to an unfolded position when the access door has reach the closed position.

12. The imaging device of claim 8 wherein at least one of the left and the right lift rails has a pull thereon accessible through the front jam door, the pull translating the at least one of the left and the right lift rails away from the rear panel and allowing the latch portion of the corresponding one of the left and the right latch arms to reengage with the corresponding at least one of the left and the right lift rails to move the corresponding one of the left and the right ends of the at least one developer unit away from the PC unit separating the at least one developer roll and the at least one PC drum along a portion of their respective axial lengths.

13. The imaging device of claim 12 wherein the pull is provided on each of the left and the right lift rails.

14. The imaging device of claim 8 further comprising a left and a right spring-biased bell crank pivotally mounted on the left and the right lift rails, respectively, a respective end of the left and right bell crank positioned adjacent to the one of the first and second portions of the at least one lift slots in the left and the right lift rails, respectively, the left and right bell cranks applying a biasing force to the left and the right lift members, respectively, to increase a contact force between the at least one developer roll and the at least one PC drum when the at least one developer unit and the at least one PC unit are in the operative position.

15. The imaging device of claim 8 wherein the at least one developer unit includes four developer units and the at least one PC unit includes four PC units and the left and the right lift rails each having respective at least one lift slot includes four lift slots, respectively, for receiving the corresponding left and right lift members of the four developer units.

16. A separator for use in an electrophotographic imaging device for separating a developer roll and a photoconductive (PC) drum mounted therein when the developer roll and the PC drum are in an operative position with developer roll and the PC drum forming contact nip along their respective axial lengths and placing the developer roll and the PC drum in a separated position where the developer roll and the PC drum are spaced apart along at least a portion of their respective axial lengths, the imaging device having a frame having an opposed first and a second panel connected with an opposed third and a fourth panel, an access door pivotally mounted between the first and the second panels and adjacent to one of the third and the fourth panels and moveable being an open position and a closed position with respect to the frame, the access door having actuation member mounted thereon, the separator comprising:

a lift rail slidably mountable to one of the third and fourth panels and biased towards one of the first and second panels in a biased positioned, the lift rail having a lift slot therein, the lift slot having a bottom with a first portion and a second portion offset from one another and connected by a camming portion; the lift slot sized to receive a lift member mounted on one of the developer roll and PC drum wherein, when the lift member is in one of the first and second portions, the developer roll and the PC drum are in the operative position, and, when the lift member is in the other of the first and second portions, the developer roll and the PC drum are in the separated position; and, a release linkage having a base link, a release arm, and a latch arm, the base member slidably attachable to one of first and second panels, the release arm pivotally mountable to the frame and pivotally attached to the base link, a latch arm pivotally mountable to the frame and pivotally attached to the base link, the latch arm biased toward the lift rail and having a latch portion engaging the lift rail when the lift rail is moved away from its biased position and holding the lift rail apart from its biased position, the release arm engageable with the actuation member wherein, with the separator installed in the imaging device with the PC drum and developer roll in the separated position, the lift member in the at least one lift slot and the access door in the closed position, on opening of the access door, the actuation member engages the release arm pivoting the release arm, translating the base link, pivoting the latch arm and disengaging the latch portion from the lift rail allowing the lift rail to return to its biased position and moving the lift member from the other of the first and second portions along the camming portion to the one of the first and second portions moving one of the developer roll and PC drum into the operative position.

17. The separator of claim 16 wherein, with the separator installed in the imaging device and the developer roll and PC drum are in the operative position, on reclosing of the access door, the actuation member initially passes the release arm without pivoting the actuator arm, and the lift rail remains in its biased position keeping the developer roll and PC drum in the operative position, and, further wherein, on reopening of the access door, the actuation member engages the actuator arm pivoting the actuator arm, translating the base member and pivoting the latch arm without the developer roll and the PC drum going to the separated position.

18. The separator of claim 16 wherein to return the developer roll and PC drum to the separated position, a translation force is applied to the lift rail moving the lift rail away from its biased position allowing the latch arm to pivot and the latch portion to reengage with the lift rail with the lift member moving to the other of the first and second portions in the lift slot.

19. The separator of claim 16 further comprising a spring-biased bell crank pivotally mounted on the lift rail having one end positioned adjacent to the one of the first and second portions of the lift slot where the developer roll and the PC drum are in the operative position for applying a biasing force to the lift member to increase a contact force between the developer roll and the PC drum.

* * * * *